US011407581B2

(12) United States Patent
Richard et al.

(10) Patent No.: US 11,407,581 B2
(45) Date of Patent: Aug. 9, 2022

(54) DISPENSING SYSTEMS

(71) Applicant: S. C. JOHNSON & SON, INC., Racine, WI (US)

(72) Inventors: Jesse Richard, Racine, WI (US); William F. Gordon, Petaluma, CA (US); Bernard Borel, Mancielles (FR); Eric Gaillard, Dieue sur Meuse (FR)

(73) Assignee: S. C. Johnson & Son, Inc., Racine, WI (US)

( * ) Notice: Subject to any disclaimer, the term of this patent is extended or adjusted under 35 U.S.C. 154(b) by 140 days.

(21) Appl. No.: 16/804,055

(22) Filed: Feb. 28, 2020

(65) Prior Publication Data

US 2020/0198875 A1 Jun. 25, 2020

Related U.S. Application Data

(62) Division of application No. 15/564,996, filed as application No. PCT/US2015/024581 on Apr. 6, 2015, now Pat. No. 10,647,501.

(51) Int. Cl.
*B65D 83/20* (2006.01)

(52) U.S. Cl.
CPC ..... *B65D 83/206* (2013.01); *B65D 83/202* (2013.01)

(58) Field of Classification Search
CPC .. B65D 83/201; B65D 83/205; B65D 83/206; B65D 83/202
See application file for complete search history.

(56) References Cited

U.S. PATENT DOCUMENTS 3,109,565 A 11/1963 Kutik
3,223,287 A 12/1965 Sagarin
3,272,391 A 9/1966 Meshberg
3,281,021 A 10/1966 Seaquist
(Continued)

FOREIGN PATENT DOCUMENTS

AU 2010101346 A4 1/2011
AU 2006279835 B2 12/2012
(Continued)

OTHER PUBLICATIONS

Second Office Action issued in corresponding Chinese Application No. 201580080697.0, dated Mar. 19, 2019, 13 pages.
(Continued)

*Primary Examiner* — Patrick M. Buechner
(74) *Attorney, Agent, or Firm* — Quarles & Brady LLP

(57) ABSTRACT

A dispensing system includes a container and an overcap. The container includes a central, longitudinal axis and a first outermost point. The first outermost point of the container is a first distance from the central, longitudinal axis along a first line perpendicular to the central, longitudinal axis. The overcap is coupled to the container and includes a pivotable trigger that is configured to pivot between an unactuated position and an actuated position. A second outermost point of the trigger is a second distance from the central, longitudinal axis along a second line perpendicular to the central, longitudinal axis when the trigger is in the unactuated position, the second distance less than the first distance. Further, the second outermost point of the trigger is to move toward the central, longitudinal axis when the trigger moves toward the actuated position.

19 Claims, 20 Drawing Sheets

(56) References Cited

U.S. PATENT DOCUMENTS 3,539,078 A 11/1970 Venus, Jr.
3,570,723 A 3/1971 Kotuby
3,578,220 A 5/1971 Green
3,591,128 A 7/1971 Ramis
3,602,407 A 8/1971 Grothoff
3,610,479 A 10/1971 Venus, Jr.
3,632,024 A 1/1972 Usen
3,642,179 A 2/1972 Micallef
3,651,993 A 3/1972 Venus, Jr.
3,661,300 A 5/1972 Nigro
3,669,359 A 6/1972 Focht
3,675,831 A 7/1972 Beres
3,680,605 A 8/1972 Nigro
3,739,941 A 6/1973 Ostrwosky et al.
3,744,682 A 7/1973 Blank
3,749,286 A 7/1973 Douglas
3,768,707 A 10/1973 Nigro
3,785,528 A 1/1974 Mandeltort
3,828,982 A 8/1974 Steigerwald
3,889,856 A 6/1975 Morane
3,912,132 A 10/1975 Stevens
3,913,805 A 10/1975 Sette
3,918,614 A 11/1975 Steiman
3,918,615 A 11/1975 Morane
3,946,911 A 3/1976 Morane et al.
3,967,760 A 7/1976 Marcon
3,987,942 A 10/1976 Morane et al.
3,991,916 A 11/1976 Del Bon
4,024,988 A 5/1977 Starrett
4,053,090 A 10/1977 Kelly et al.
4,067,482 A 1/1978 Vogel et al.
4,068,782 A 1/1978 Van der Heijden
4,095,725 A 6/1978 Goncalves
4,132,333 A 1/1979 Debard
4,132,359 A 1/1979 Nozawa
4,154,378 A 5/1979 Paoletti et al.
4,166,554 A 9/1979 Anderson
4,219,135 A 8/1980 Ufferfilge
4,294,410 A 10/1981 Gueret
4,304,342 A * 12/1981 Morane ..... B65D 83/46
222/402.23
4,353,483 A 10/1982 Pehr
4,378,081 A 3/1983 van Lit
4,381,065 A 4/1983 Hayes
4,393,984 A 7/1983 Debard
4,420,099 A 12/1983 Pizzurro et al.
4,428,509 A 1/1984 Emerson et al.
4,442,959 A 4/1984 Del Bon et al.
4,493,444 A 1/1985 Del Bon et al.
4,506,808 A 3/1985 Goncalves
4,511,064 A 4/1985 Ruscitti et al.
4,513,890 A 4/1985 Goncalves
4,533,483 A 8/1985 Watson et al.
4,572,410 A 2/1986 Brunet
4,720,046 A 1/1988 Morane
4,728,007 A 3/1988 Samuelson et al.
4,740,366 A 4/1988 Winston et al.
4,752,020 A 6/1988 Grueter et al.
4,775,081 A 10/1988 Morane
4,791,723 A 12/1988 Jacobson
4,830,229 A 5/1989 Ball
4,848,946 A 7/1989 Goncalves
4,858,792 A 8/1989 de Laforcade
4,875,604 A 10/1989 Czech
4,892,231 A 1/1990 Ball
4,896,832 A 1/1990 Howlett
4,901,891 A 2/1990 Goncalves
4,941,600 A 7/1990 Berriochoa et al.
4,946,074 A 8/1990 Grogan
4,977,142 A 12/1990 Green
4,977,192 A 12/1990 Martineu et al.
4,978,035 A 12/1990 Morane et al.
5,018,647 A 5/1991 Abplanalf
5,052,585 A 10/1991 Bolduc
5,083,681 A 1/1992 Nye
5,139,201 A 8/1992 De Laforcade
5,154,323 A 10/1992 Query et al.
5,154,328 A 10/1992 Gueret
5,169,032 A 12/1992 Steijns et al.
5,228,600 A 7/1993 Steijns et al.
5,232,127 A 8/1993 Trotta et al.
5,242,090 A 9/1993 Reyss
5,244,128 A 9/1993 De Laforcade
5,263,616 A 11/1993 Abplanalp
5,271,432 A 12/1993 Gueret
5,271,533 A 12/1993 Joulia
5,301,850 A 4/1994 Gueret
5,305,930 A 4/1994 De Laforcade
5,360,145 A 11/1994 Gueret
5,379,924 A 1/1995 Taylor
5,388,730 A 2/1995 Abbott et al.
5,413,250 A 5/1995 Gueret
5,417,357 A 5/1995 Yquel
5,439,141 A 8/1995 Clark et al.
5,480,095 A 1/1996 Stevenson et al.
5,482,186 A 1/1996 Rodden, Jr.
5,492,252 A 2/1996 Gueret
5,503,303 A 4/1996 LaWare et al.
5,505,341 A 4/1996 Gueret
5,535,950 A 7/1996 Barriac et al.
5,586,693 A 12/1996 De Laforcade
5,588,566 A 12/1996 de Laforcade et al.
5,597,095 A 1/1997 Ferrara, Jr.
5,603,434 A 2/1997 von Schuckmann
5,624,055 A 4/1997 Clanet et al.
5,641,095 A 6/1997 de Laforcade
5,649,645 A 7/1997 Demarest et al.
5,716,008 A 2/1998 Nottingham et al.
5,725,155 A 3/1998 Grunenberg et al.
5,752,737 A 5/1998 Heldt et al.
5,779,109 A 7/1998 Gueret
5,839,616 A 11/1998 Irwin et al.
5,915,597 A 6/1999 De Laforcade
5,927,568 A 7/1999 De Nervo et al.
5,984,149 A 11/1999 Thanisch et al.
5,988,453 A 11/1999 de Laforcade et al.
6,004,056 A 12/1999 De Laforcade
6,016,939 A 1/2000 Gueret
6,095,377 A 8/2000 Sweeton et al.
6,112,953 A 9/2000 Gueret
6,116,472 A 9/2000 Wanbaugh et al.
6,131,820 A 10/2000 Dodd
6,161,736 A 12/2000 Kaufman et al.
6,199,766 B1 3/2001 Fox et al.
6,227,417 B1 5/2001 De LaForcade et al.
6,253,965 B1 7/2001 Pitocco
6,267,297 B1 7/2001 Contadini et al.
6,279,834 B1 8/2001 Fox et al.
6,286,728 B1 9/2001 Driskell et al.
6,318,595 B1 11/2001 Walters
6,332,562 B1 12/2001 Sweeton
6,378,786 B1 4/2002 Beeston et al.
6,384,310 B2 5/2002 Aoki et al.
6,405,898 B1 6/2002 OConnor et al.
6,464,111 B2 10/2002 de LaForcade et al.
6,482,357 B1 11/2002 Fox et al.
6,502,766 B1 1/2003 Streutker et al.
6,510,847 B1 1/2003 Helgesson et al.
RE38,022 E 3/2003 De Laforcade
6,592,813 B1 7/2003 Fox et al.
6,612,510 B1 9/2003 Fox et al.
6,644,507 B2 11/2003 Borut et al.
6,701,663 B1 3/2004 Hughes et al.
6,722,532 B2 4/2004 Lasserre et al.
6,739,479 B2 5/2004 Contadini et al.
6,758,373 B2 7/2004 Jackson et al.
6,769,580 B2 8/2004 Muderlak et al.
6,790,408 B2 9/2004 Whitby et al.
6,834,778 B2 12/2004 Jinbo et al.
6,877,271 B2 4/2005 Hughes et al.
6,918,547 B2 7/2005 Jaeger et al.
6,969,046 B2 11/2005 Streutker et al.
6,978,946 B2 12/2005 Sweeton
6,981,658 B2 1/2006 Streutker et al.

(56) References Cited

U.S. PATENT DOCUMENTS

| | | | |
|---|---|---|---|
| 7,000,805 | B1 | 2/2006 | Wu et al. |
| 7,004,359 | B2 | 2/2006 | Marroncles |
| 7,104,427 | B2 | 9/2006 | Pericard et al. |
| 7,108,159 | B2 | 9/2006 | Stradella |
| 7,137,536 | B2 | 11/2006 | Walters et al. |
| 7,137,537 | B2 | 11/2006 | Rueschhoff et al. |
| 7,140,515 | B2 | 11/2006 | Cardwell, III et al. |
| 7,175,111 | B2 | 2/2007 | Wanbaugh et al. |
| 7,204,393 | B2 | 4/2007 | Strand |
| 7,222,802 | B2 | 5/2007 | Sweeton |
| 7,296,712 | B2 | 11/2007 | Stradella |
| 7,325,705 | B2 | 2/2008 | Sweeton |
| 7,344,053 | B2 | 3/2008 | Sweeton |
| 7,350,675 | B2 | 4/2008 | Sweeton |
| 7,360,672 | B2 | 4/2008 | Sweeton |
| 7,455,198 | B2 | 11/2008 | Foster et al. |
| 7,478,738 | B2 | 1/2009 | Jones et al. |
| 7,497,358 | B2 | 3/2009 | Clynes et al. |
| 7,509,955 | B2 | 3/2009 | Cole et al. |
| 7,571,836 | B2 | 8/2009 | Foster et al. |
| 7,621,468 | B2 | 11/2009 | Smith et al. |
| 7,637,396 | B2 | 12/2009 | Foster et al. |
| 7,651,013 | B2 | 1/2010 | Laidler et al. |
| 7,677,416 | B2 | 3/2010 | Foster et al. |
| 7,721,920 | B2 | 5/2010 | Ruiz De Gopegui et al. |
| 7,784,650 | B2 | 8/2010 | Bates et al. |
| 7,789,278 | B2 | 9/2010 | Ruiz de Gopegui et al. |
| 7,854,356 | B2 | 12/2010 | Eberhardt |
| 7,882,990 | B1 | 2/2011 | Walters et al. |
| 7,922,041 | B2 | 4/2011 | Gurrisi et al. |
| 7,942,291 | B2 | 5/2011 | Foster |
| 7,959,040 | B2 | 6/2011 | Heirman |
| 8,016,167 | B2 | 9/2011 | Tomkins et al. |
| 8,066,155 | B2 | 11/2011 | Tada |
| 8,083,161 | B2 | 12/2011 | Lind et al. |
| 8,087,546 | B2 | 1/2012 | Rabinovitch |
| 8,087,552 | B2 | 1/2012 | Fazekas et al. |
| 8,123,082 | B2 | 2/2012 | Hayton et al. |
| 8,196,784 | B2 | 6/2012 | Tomkins et al. |
| 8,201,714 | B2 | 6/2012 | Tomkins et al. |
| 8,322,630 | B2 | 12/2012 | Richardson et al. |
| 8,322,631 | B2 | 12/2012 | Richardson et al. |
| 8,356,734 | B2 | 1/2013 | Oshimo et al. |
| 8,444,026 | B2 | 5/2013 | Adams et al. |
| 8,499,984 | B2 | 8/2013 | Strand |
| 8,517,221 | B2 | 8/2013 | Sweeton et al. |
| 8,517,227 | B2 | 8/2013 | Strand et al. |
| 8,528,794 | B2 | 9/2013 | Wolf et al. |
| 8,733,341 | B2 | 5/2014 | Boeck et al. |
| 8,752,737 | B2 | 6/2014 | Ghavami-Nasr et al. |
| 8,807,396 | B2 | 8/2014 | Bodet et al. |
| 8,863,995 | B2 | 10/2014 | Stegeman |
| 8,881,944 | B2 | 11/2014 | Paas et al. |
| 8,887,963 | B2 | 11/2014 | Zizoune et al. |
| 8,905,271 | B2 | 12/2014 | Maas et al. |
| 8,936,180 | B2 | 1/2015 | Sell |
| 8,960,503 | B2 | 2/2015 | Soliman |
| 8,998,041 | B2 | 4/2015 | Strand |
| 9,022,301 | B2 | 5/2015 | Sell et al. |
| 2004/0140328 | A1 | 7/2004 | Pericard et al. |
| 2004/0222246 | A1 | 11/2004 | Bates et al. |
| 2006/0273110 | A1 | 12/2006 | Jacobs et al. |
| 2006/0273111 | A1 | 12/2006 | Heatley et al. |
| 2007/0023457 | A1 | 2/2007 | O'Toole et al. |
| 2007/0034653 | A1 | 2/2007 | Strand |
| 2007/0051754 | A1 | 3/2007 | Strand et al. |
| 2007/0210106 | A1 | 9/2007 | Foster |
| 2008/0035638 | A1 | 2/2008 | Burghaus et al. |
| 2008/0190968 | A1 | 8/2008 | Heirman |
| 2009/0084870 | A1 | 4/2009 | Smith et al. |
| 2009/0127293 | A1 | 5/2009 | De Laforcade |
| 2009/0283609 | A1 | 11/2009 | Strand |
| 2010/0025437 | A1 | 2/2010 | Oshimo et al. |
| 2010/0059551 | A1 | 3/2010 | Tomkins et al. |
| 2010/0219211 | A1 | 9/2010 | Smith et al. |
| 2011/0017701 | A1 | 1/2011 | Soliman |
| 2011/0108583 | A1 | 5/2011 | Sell et al. |
| 2011/0132936 | A1 | 6/2011 | Weng |
| 2011/0147419 | A1 | 6/2011 | Tada et al. |
| 2011/0192867 | A1 | 8/2011 | Best et al. |
| 2011/0220685 | A1 | 9/2011 | Lind et al. |
| 2011/0233235 | A1 | 9/2011 | Adams et al. |
| 2012/0048959 | A1 | 3/2012 | Maas et al. |
| 2012/0097713 | A1 | 4/2012 | MacKinnon et al. |
| 2012/0175433 | A1 | 7/2012 | Sell et al. |
| 2012/0312896 | A1 | 12/2012 | Thurin et al. |
| 2012/0325503 | A1 | 12/2012 | Fishman et al. |
| 2013/0037581 | A1 | 2/2013 | Andersen et al. |
| 2013/0037582 | A1 | 2/2013 | Andersen et al. |
| 2013/0112766 | A1 | 5/2013 | Maas et al. |
| 2013/0140333 | A1 | 6/2013 | Sell |
| 2013/0146611 | A1 | 6/2013 | Sell |
| 2013/0153607 | A1 | 6/2013 | Sell |
| 2013/0175305 | A1 | 7/2013 | Ohshima |
| 2013/0193233 | A1 | 8/2013 | Sell |
| 2013/0228593 | A1 | 9/2013 | Adams et al. |
| 2013/0277397 | A1 | 10/2013 | Erickson et al. |
| 2013/0284767 | A1 | 10/2013 | Strand |
| 2014/0084026 | A1 | 3/2014 | Gillespie et al. |
| 2014/0110440 | A1 | 4/2014 | Good et al. |
| 2014/0123833 | A1 | 5/2014 | Yung |
| 2015/0008267 | A1 | 1/2015 | Maas et al. |
| 2015/0014442 | A1 | 1/2015 | Fishman et al. |
| 2015/0021413 | A1 | 1/2015 | Fishman et al. |
| 2016/0009479 | A1 | 1/2016 | Driskell et al. |
| 2019/0256278 | A1 | 8/2019 | Brown et al. |
| 2019/0283959 | A1 | 9/2019 | Rasel et al. |
| 2019/0322442 | A1 | 10/2019 | Thomsen |

FOREIGN PATENT DOCUMENTS

| | | | |
|---|---|---|---|
| CA | 2618034 | C | 3/2014 |
| DE | 69910781 | T2 | 7/2004 |
| EP | 0693439 | B1 | 10/2001 |
| EP | 0991477 | B1 | 4/2003 |
| EP | 1091766 | B1 | 8/2003 |
| EP | 1091767 | B1 | 8/2003 |
| EP | 1024902 | B1 | 3/2005 |
| EP | 1620328 | B1 | 7/2007 |
| EP | 1462180 | B1 | 3/2009 |
| EP | 1727745 | B1 | 4/2009 |
| EP | 2060507 | A2 | 5/2009 |
| EP | 2233213 | A1 | 9/2010 |
| EP | 2615044 | A1 | 7/2013 |
| EP | 1912879 | B1 | 11/2013 |
| EP | 2219975 | B1 | 7/2014 |
| EP | 2483175 | B1 | 11/2016 |
| JP | H11-156251 | A | 6/1999 |
| JP | 2001315871 | A | 11/2001 |
| JP | 2002166982 | A | 6/2002 |
| JP | 2003305390 | A | 10/2003 |
| JP | 2005154013 | A | 6/2005 |
| JP | 2008174280 | A | 7/2008 |
| JP | 2012091145 | A | 5/2012 |
| JP | 2013126646 | A | 6/2013 |
| JP | 2014037268 | A | 2/2014 |
| WO | 9712227 | A1 | 4/1997 |
| WO | 9728883 | A1 | 8/1997 |
| WO | 2004008110 | A2 | 1/2004 |
| WO | 2009045426 | A1 | 4/2009 |
| WO | 2009078303 | A1 | 6/2009 |
| WO | 2009152112 | A1 | 12/2009 |
| WO | 2010041411 | A1 | 4/2010 |
| WO | 2011041514 | A1 | 4/2011 |
| WO | 2012166793 | A1 | 12/2012 |
| WO | 2014123833 | A1 | 8/2014 |

OTHER PUBLICATIONS

International Search Report and Written Opinion, International Application No. PCT/US2015/024581, dated Feb. 16, 2017, 18 pages.

(56) References Cited

OTHER PUBLICATIONS

Notification of Reason for Refusal issued in corresponding Korean Application No. 10-2017-7032027, dated Dec. 3, 2018, 25 pages.
Notification of Reasons for Refusal issued in corresponding Japanese Application No. 2017-550539, dated Dec. 18, 2018, 7 pages.
Jean A. Cross, "Electrostatics: Principiles, Problems and Applications," ISBN 0-85274-589-3, IOP Publishing Limited, 1987, 8 pages.
L.F. Gaunt et al., "Electrostatic charging of trigger actuated spray devices," University of Southampton, Institute of Physics Publishing, Electrostatics 2003, 8 pages.
N. Toljic et al., "Determination of Particle Charge to Mass Ratio Distribution in Electrostatic Applications: A Brief Review," University of Western Ontario, Proc. ESA Annual Meeting on Electrostatics 2008, Paper G2, pp. 1-9.
T. Gemci et al., "Determination of Individual Droplet Charge in Electrosprays From PDPA Measurements," Carnegie Mellon University, ILASS—Europe 2002, Zaragoza Sep. 9-11, 2002, 6 pages.
Zohra Olumee et al., "Droplet Dynamics Changes in Electrostatic Sprays of Methanol-Water Mixtures," The George Washington University, J. Phys. Chem. A 1998, 102, Sep. 22, 1998, pp. 9154-9160.
T. Gillespie et al., "An Instrument for Determining the Electric Charge Distribution in Aerosols," Canadin Journal of Chemistry, vol. 30, Aug. 5, 1952, pp. 1056-1068.

* cited by examiner

DISPENSING SYSTEMS

CROSS REFERENCE TO RELATED APPLICATIONS

The present application is a divisional application of U.S. application Ser. No. 15/564,996, filed on Oct. 6, 2017 and entitled "DISPENSING SYSTEMS", which represents the United States National Stage of International Patent Application No. PCT/US2015/024581, filed Apr. 6, 2015, which are incorporated by reference herein in its entirety.

REFERENCE REGARDING FEDERALLY SPONSORED RESEARCH OR DEVELOPMENT

Not applicable.

SEQUENCE LISTING

Not applicable.

BACKGROUND OF THE DISCLOSURE

1. Field of the Disclosure

The present disclosure relates to an apparatus for dispensing a fluid product, and in particular, to a manually actuable dispensing system.

2. Description of the Background of the Disclosure

Traditional dispensing systems employ an overcap coupled to an aerosol container. Typically, a lower end or skirt of the overcap is thick and forms a step or ridge relative to the container when the overcap is coupled to the container. Consumers often find the step or ridge uncomfortable when gripping the dispensing system. In addition, traditional overcaps may not be suitable for consumers with hands of above-average size or below-average size.

Such dispensing systems also typically include an actuator such as a trigger or a button. When activated by a user, the actuator causes a manifold to actuate a valve stem of a container. The manifold typically includes a spray insert having a discharge outlet in fluid communication with the valve stem. Traditionally, the entire manifold moves relative to the overcap during actuation of the actuator. As a result, the dispensing system may inaccurately spray a fluid product or require undesirable movement on the part of the user's hand.

SUMMARY

According to a first aspect, a dispensing system includes a housing for coupling to a container. The housing has a first sidewall including an aperture. The overcap also includes a trigger having a grip portion disposed outside of the housing and an arm extending through the aperture of the first sidewall and pivotably coupled to a fulcrum spaced apart from the first sidewall. The overcap further includes a cap coupled to the housing and a manifold suspended from the cap.

According to another aspect, a dispensing system includes a housing for coupling to a container. The housing has a first sidewall including an aperture. The overcap also includes a trigger pivotably coupled to the housing and a cap coupled to the housing. A manifold is unitary with the cap.

According to a different aspect, a dispensing system has a longitudinal axis and a housing including a first sidewall having an aperture. The dispensing system also includes a trigger having a grip portion disposed outside of the housing and an arm. The arm extends through the aperture of the first sidewall and is pivotably coupled to a second sidewall of the housing opposite the first sidewall. The dispensing system further includes a cap coupled to the housing and a manifold integrally formed with the cap. The manifold has an end portion to receive a valve stem of a container. A discharge aperture is in fluid communication with the manifold. A first plane perpendicular to the longitudinal axis passes through the discharge aperture, a second plane perpendicular to the longitudinal axis passes through an axis of rotation of the trigger, and a third plane perpendicular to the longitudinal axis passes through the end portion of the manifold. The second plane is disposed between the first plane and the third plane.

According to yet another aspect, a dispensing system includes a container and an overcap. The container has a central, longitudinal axis and a first outermost point. The first outermost point of the container is a first distance from the central, longitudinal axis along a first line perpendicular to the central, longitudinal axis. The overcap is coupled to the container and includes a pivotable trigger that is configured to pivot between an actuated position and an unactuated position. A second outermost point of the trigger is a second distance from the central, longitudinal axis along a second line perpendicular to the central, longitudinal axis when the trigger is in the unactuated position, the second distance less than the first distance. Further, the second outermost point of the trigger is to move toward the central, longitudinal axis when the trigger moves toward the actuated position.

According to still another aspect, a dispensing system includes a container including a mounting cup. The container has a first footprint. An overcap is coupled to the container. The overcap has a second footprint and includes a pivotable trigger having a portion extending below the mounting cup of the container when the dispensing system is in an upright position. The second footprint of the overcap is disposed entirely within the first footprint.

According to another aspect, a dispensing system includes a container having a cylindrical portion including a radius and a central, longitudinal axis perpendicular to the radius. A housing is coupled to the container. The dispensing system also includes a trigger pivotably coupled to the housing. A grip portion of the trigger is disposed outside of the housing and no portion of the grip portion is disposed farther from the longitudinal axis in a direction perpendicular to the longitudinal axis than a distance equal to the radius of the cylindrical portion.

According to another aspect, an overcap includes a housing having a first sidewall and a second sidewall opposite the first sidewall. A trigger is pivotably coupled to the housing and has a grip portion disposed outside of the housing adjacent the first sidewall. The grip portion has a length of about 40 millimeters to about 60 millimeters. The grip portion is concave and has a first radius of curvature, and the second sidewall is concave and has a second radius of curvature less than the first radius of curvature. The overcap has a waist of about 30 millimeters to about 50 millimeters.

According to a different aspect, a dispensing system includes a housing and a discharge outlet. A trigger has a grip portion pivotably coupled to the housing to rotate from a first position to a second position. The grip portion has an upper surface and an interior surface disposed below the discharge outlet when the dispensing system is in an upright position. The upper surface of the grip portion is to move outward when the grip portion rotates from the first position to the second position to enable at least one of the upper surface or the interior surface to direct a fluid product discharged via the discharge outlet into an interior of the housing.

According to yet another aspect, a dispensing system includes a container and a housing to be coupled to the container. The housing includes a flexible skirt having an interior face extending toward an exterior face such that a: thickness of the end of the skirt is between about 0.3 millimeters and about 1.0 millimeters. The skirt in a first state uncoupled to the container defines an aperture with a first size, and the skirt in a second state coupled to the container defines the aperture with a second size greater than the first size and forms a circumferential fluid seal between the skirt and the container.

According to a different aspect, a dispensing system includes a container and a housing to be coupled to the container. The housing includes a flexible skirt having an interior face extending toward an exterior face such that a ratio of a first thickness of an area of the skirt spaced apart from an end of the skirt to a second thickness of the end of the skirt is greater than about 1.5:1. The skirt in a first state uncoupled to the container defines an aperture with a first size, and the skirt in a second state coupled to the container defines the aperture with a second size greater than the first size and forms a circumferential fluid seal between the skirt and the container.

According to different aspect, a dispensing system includes a housing for coupling to a container. The housing has a first sidewall including an aperture. The system also includes a trigger having a grip portion disposed outside of the housing and an arm extending through the aperture of the first sidewall and pivotably coupled to a second sidewall of the housing opposite the first sidewall. The system further includes a cap coupled to the housing and a manifold suspended from the cap. The trigger is operatively coupled to the manifold such that when a first portion of the trigger moves along a first arcuate path, a second portion of the manifold moves along a second arcuate path opposing the first arcuate path.

According to another aspect, a dispensing system includes a container and an overcap coupled to the container. The container has a central, longitudinal axis and a first outermost point. The first outermost point of the container is a first distance from the central, longitudinal axis along a first line perpendicular to the central, longitudinal axis. The overcap includes a trigger that is configured to angularly move between an unactuated position and an actuated position. A second outermost point of the trigger is a second distance from the central, longitudinal axis along a second line perpendicular to the central, longitudinal axis when the trigger is in the unactuated position. The second distance is less than the first distance. Further, the second outermost point of the trigger is to move toward the central, longitudinal axis when the trigger moves toward the actuated position.

According to still another aspect, a dispensing system includes a container and an overcap coupled to the container. The container has a central, longitudinal axis and a first outermost point. The first outermost point of the container is a first distance from the central, longitudinal axis along a first line perpendicular to the central, longitudinal axis. The overcap includes a trigger that is configured to move between an unactuated position and an actuated position. A second outermost point of the trigger is a second distance from the central, longitudinal axis along a second line perpendicular to the central, longitudinal axis when the trigger is in the unactuated position. The second distance is less than the first distance. The second outermost point of the trigger is to move toward the central, longitudinal axis when the trigger moves toward the actuated position.

DETAILED DESCRIPTION

Figure 1:
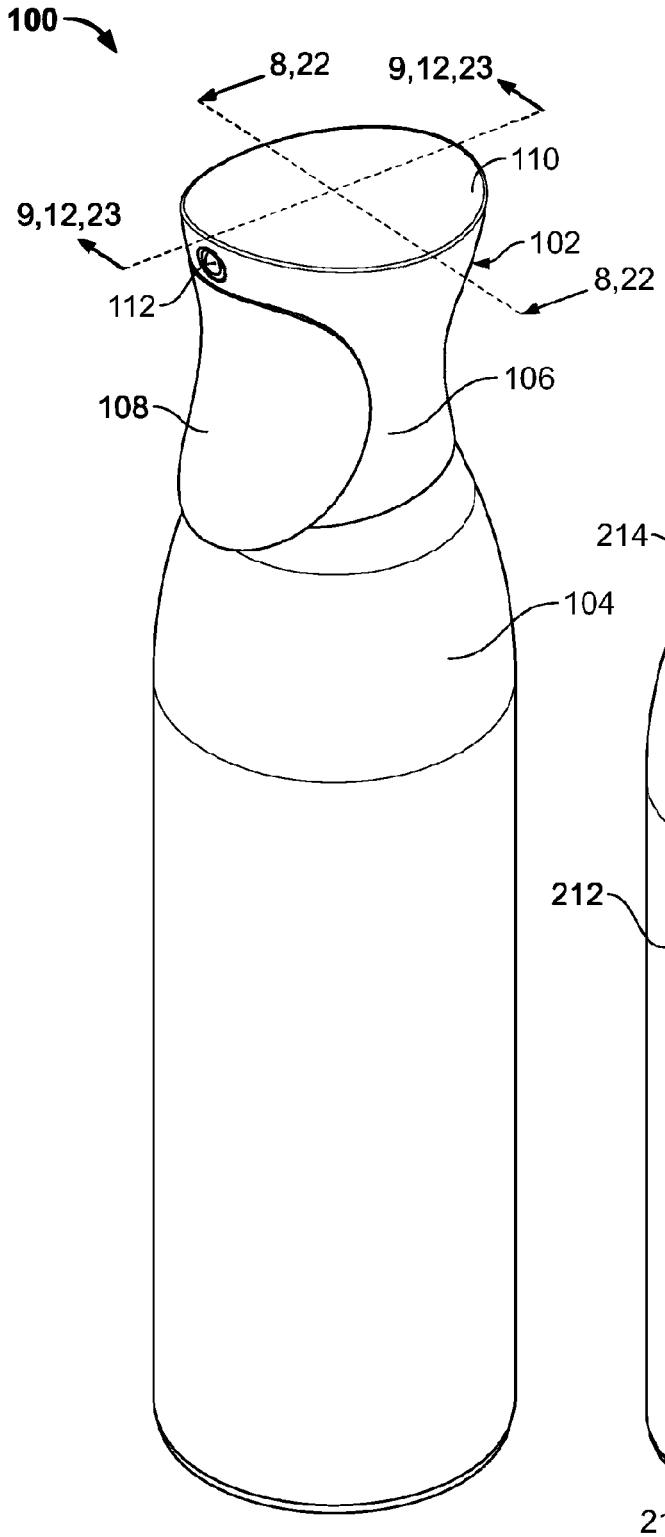
FIG. 1 is a front, top isometric view of a dispensing system.

FIG. 1 illustrates an example dispensing system 100 disclosed herein. The dispensing system 100 of FIG. 1 includes an overcap 102 and an aerosol container 104. The overcap 102 includes a housing 106, a trigger 108, a cap or lid 110, and a spray insert 112. The container 104 holds and/or stores a fluid product such as, a fragrance, insecticide, a deodorizer, a fungicide, a bacteriocide, a sanitizer, a pet barrier, or other active volatile or other compound disposed within a carrier liquid (for example, an oil-based and/or water-based carrier), a deodorizing liquid, or the like. For example, the liquid may comprise PLEDGE®, a surface cleaning active, RAID®, a pest control active, OUST®, an air and carpet sanitizer, or GLADE®, a deodorant, all sold by S. C. Johnson and Son, Inc., of Racine, Wis., for household, commercial, and institutional use. The liquid may also comprise other actives, such as sanitizers, air and/or fabric fresheners, cleaners, odor eliminators, mold or mildew inhibitors, insect repellents, and the like, or others that have aromatherapeutic properties. The liquid alternatively comprises any fluid known to those skilled in the art that can be dispensed from the container 104. The container 104 may employ a propellant such as, for example, compressed gas, liquefied petroleum gas (LPG), and/or one or more additional and/or alternative propellants to facilitate dispensing of the fluid product from the container 104.

Figure 2:
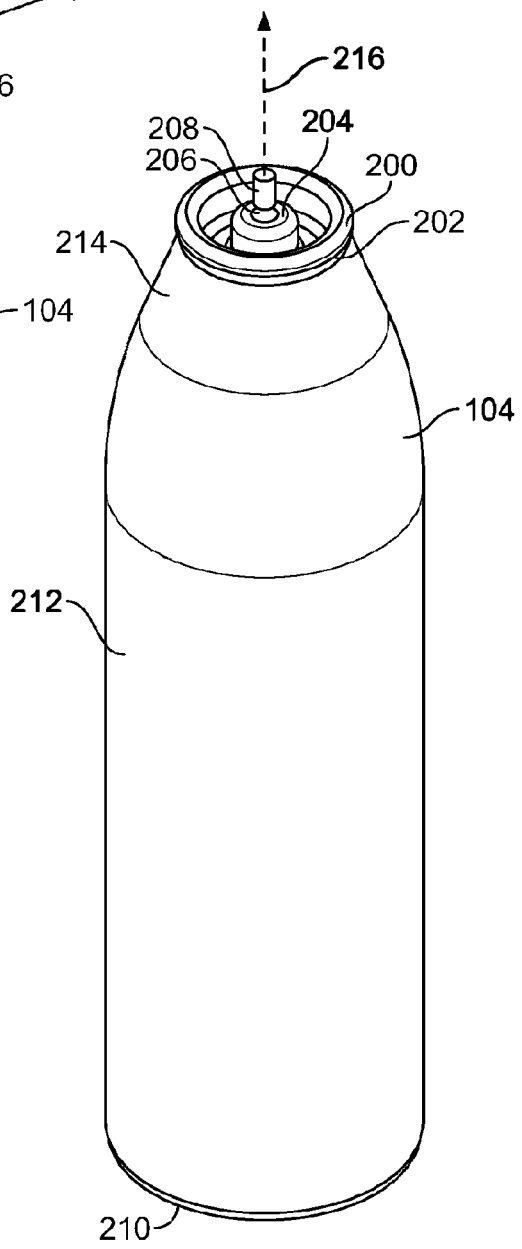
FIG. 2 is a front, top isometric view of a container of the dispensing system of FIG. 1.

FIG. 2 is an isometric view of the container 104 of FIG. 1. The container 104 includes a mounting cup 200 disposed on a first end 202 of the container 104. The mounting cup 200 of FIG. 2 includes an armular ridge. In other embodiments, the mounting cup 200 may be other shapes and/or have different configurations. A pedestal 204 is disposed on the first end 202 of the container 104 interiorly of the mounting cup 200. The pedestal 204 of FIG. 2 is a cylindrical protrusion. In the illustrated embodiment, the mounting cup 200 and the pedestal 204 are integrally formed and/or unitary. In other embodiments, the pedestal 204 may have other shapes and/or configurations. The pedestal 204 includes an aperture 206 through which a vertical valve stem 208 extends out of the pedestal 204. The vertical valve stem 208 is operatively coupled to a valve assembly (not shown) disposed in the container 104. When the valve stem 208 is depressed, the valve assembly opens to permit the fluid product to be discharged from the container 104 via the valve stem 208. In other embodiments, a tilt valve stem may be similarly employed to discharge fluid upon actuation. In the illustrated embodiment, the container 104 includes a second or bottom end 210 that is shaped and dimensioned to enable the second end 210 to support the container 104 on a surface in an upright position as shown in FIG. 2. The container 210 also includes a cylindrical portion 212 and a neck 214. The container 104 of FIG. 2 has a central, longitudinal axis 216.

Figure 3:
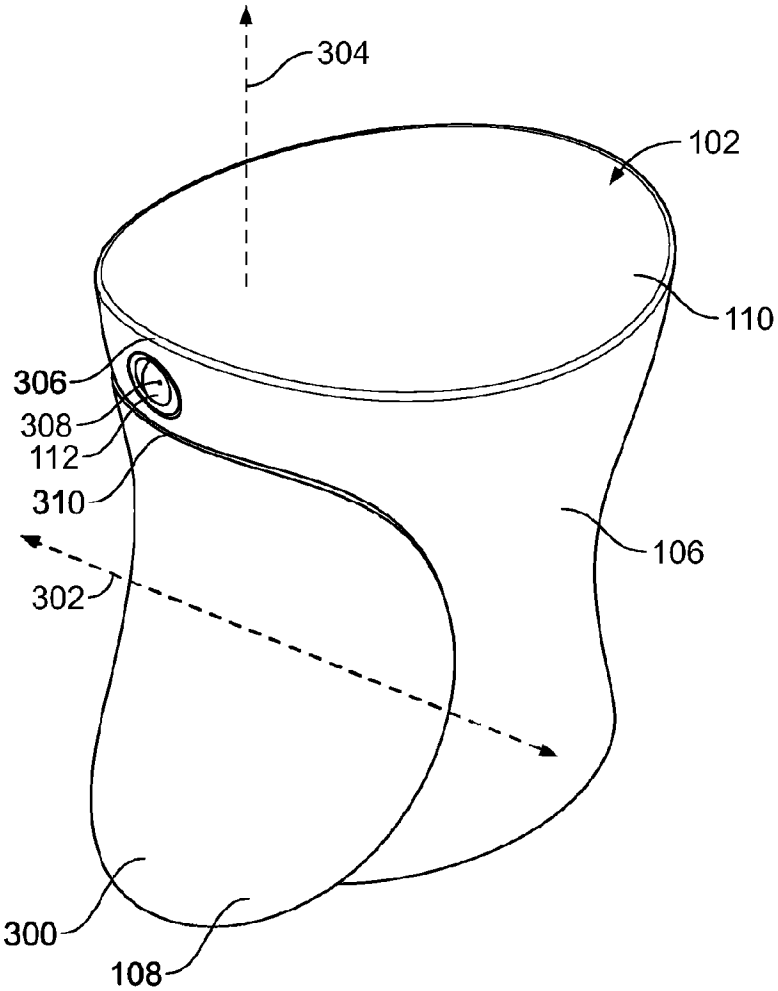
FIG. 3 is a front, top isometric view of an overcap of the dispensing system of FIG. 1.

FIG. 3 is an isometric view of the overcap 102 of FIG. 1. The trigger 108 of FIG. 3 includes a saddle shaped or hyperbolic paraboloid shaped grip portion 300. Thus, the grip portion 300 is curved about a first axis of curvature 302 and a second axis of curvature 304 substantially perpendicular to the first axis of curvature 302. In other embodiments, the grip portion 300 has other shapes. The grip portion 300 is disposed outside of the housing 106 and, thus, the grip portion 300 is accessible to the user such that the user can squeeze the grip portion 300 toward the housing 106 via one or more fingers. In the illustrated embodiment, the grip portion 300 is outside of the housing adjacent a first sidewall 306 of the housing 106. The grip portion 300 of the trigger 108 is also disposed below the spray insert 112 when the dispensing system 100 and, thus, the overcap 102 are in a partially upright or upright position. Thus, a discharge outlet 308 of the spray insert 112 is disposed above the grip portion 300 of the trigger 108 when the dispensing system 100 is in the partially upright position or the upright position. Thus, when a user grips the overcap 102 and/or the container 104 when the dispensing system 100 is in the upright position or the partially upright position, the discharge outlet 308 of the spray insert 112 is disposed above one or more fingers of the user used to actuate the trigger 108 via the grip portion 300. However, as described in greater detail below in conjunction with FIG. 16, in some embodiments an upper or first end 310 of the trigger 108 moves away from the housing 106 during actuation of the trigger 108 to a position between the discharge outlet 308 and the user's fingers such that the trigger 108 prevents drippings of the fluid product, if any, from contacting the user's hand.

Figure 4:
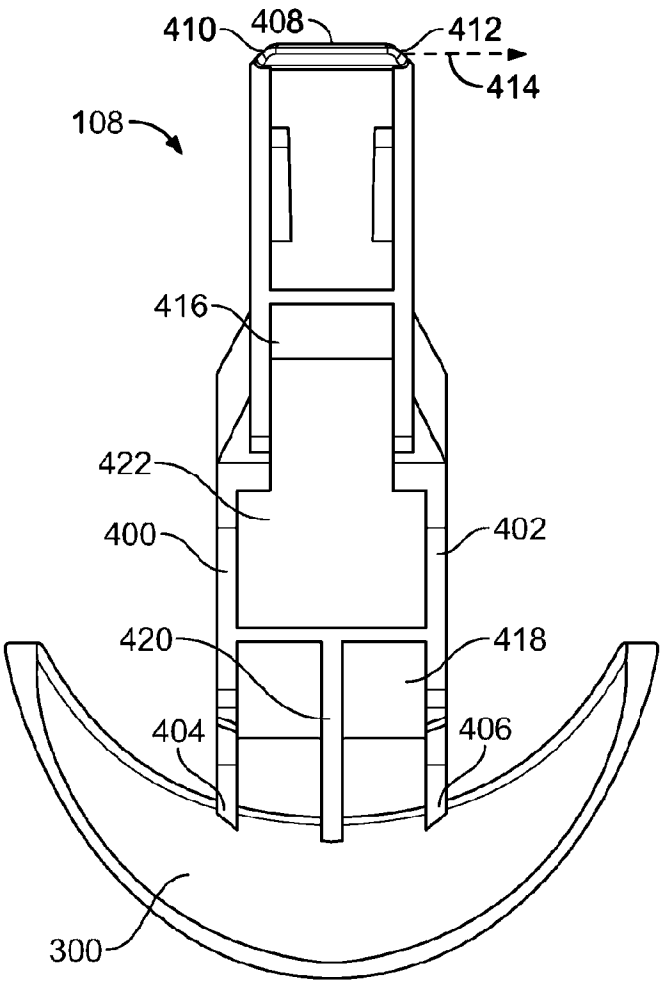
FIG. 4 is a bottom view of a trigger of the overcap of FIG. 3.

FIG. 4 is a bottom view of the trigger 108 of FIGS. 1 and 3. In the illustrated embodiment, the trigger 108 includes a first arm 400 and a second arm 402. In other embodiments, the trigger 108 includes other numbers of arms (e.g., 1, 3, 4, 5, 6, . . . , etc.). Proximal ends 404, 406 of the first arm 400 and the second arm 402, respectively, are coupled to the grip portion 300. In the illustrated embodiment, the first arm 400 and the second arm 402 are coupled to the grip portion 300 via integrally forming the first arm 400, the second arm 402, and the grip portion 300. For example, the first arm 400, the second arm 402, and the grip portion 300 may be a single piece of plastic. In other embodiments, the first arm 400 and/or the second arm 402 may be coupled to the grip portion 300 via one or more mechanical fasteners (e.g., nails, screws, clips, clamps, tape, welds, threads, etc.) and/or chemical fasteners (e.g., glue, epoxy, etc.). The first arm 400 and the second arm 402 extend from the grip portion 300. In the illustrated embodiment, the first arm 400 is substantially parallel to the second arm 402. In some embodiments, the first arm 400 and the second arm 402 are substantially perpendicular to the grip portion 300. In other embodiments, the first arm 400 and the second arm 402 are oriented at other angles relative to the grip portion 300.

The trigger 108 includes a pivot 408. In the illustrated embodiment, the pivot 408 is a crossbeam extending from a first distal end 410 of the first arm 400 to a second distal end 412 of the second arm 402. The pivot 408 defines an axis of rotation 414 of the trigger 108. The trigger 108 also includes a first brace 416 and a second brace 418. Each of the first brace 416 and the second brace 418 extend from the first arm 400 to the second arm 402 to provide rigidity to the trigger 108. A third brace 420 extends from the second brace 418 to the grip portion 300 to provide rigidity to the trigger 108. In the illustrated embodiment, the first arm 400, the second arm 402, the pivot 408, the first brace 416, the second brace 418, the third brace 420, and the grip portion 300 are unitary and/or integrally formed. In other embodiments, the pivot 408, the first brace 416, the second brace 418, and/or the third brace 420 are coupled to the first arm 400, the second arm 402, and/or the grip portion 300 via one or more mechanical and/or chemical fasteners. In the illustrated embodiment, the first brace 416, the second brace 418, the first arm 400 and the second arm 402 define a space or aperture 422. As described in greater detail below, a manifold 600 (see FIG. 10) extends through the aperture 422. The trigger 108 is sufficiently rigid such that that trigger 108 substantially does not deflect or bend during actuation of the trigger 108.

Figure 5:
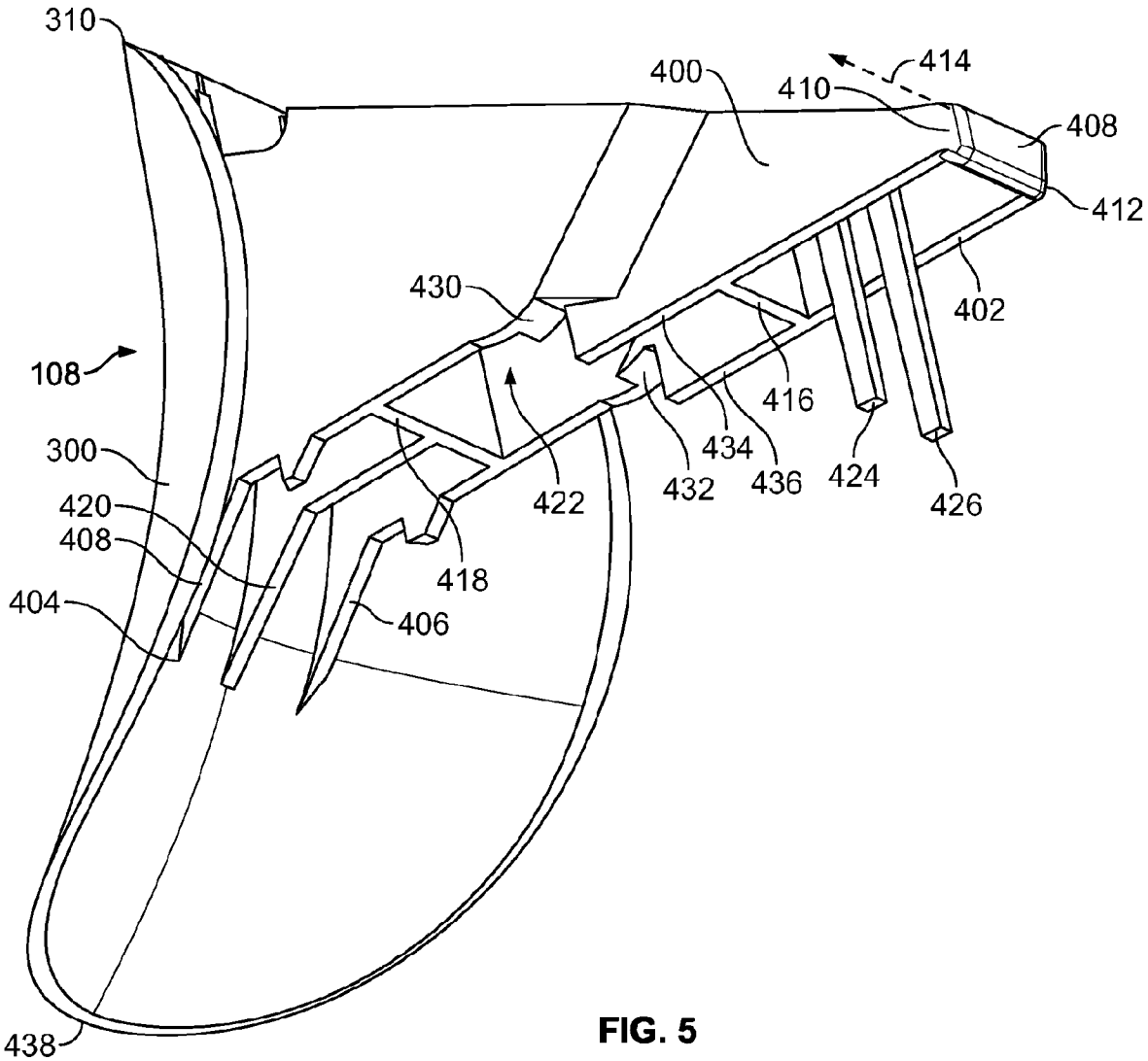
FIG. 5 is a rear, bottom isometric view of the trigger of FIG. 4.

FIG. 5 is a bottom, rear isometric view of the trigger 108 of FIG. 4. The trigger 108 includes a first spring 424 and a second spring 426. In the illustrated embodiment, the first spring 424 is a bar coupled to the first arm 400 between the pivot 408 and the first brace 416. The first spring 424 extends downward and rearward from the first arm 400 in the orientation of FIG. 5. The second spring 426 is a bar coupled to the second arm 402 between the pivot 408 and the first brace 416. The second spring 426 extends downward and rearward from the second arm 402 in the orientation of FIG. 5. As described in greater detail below, when the trigger 108 rotates to actuate the valve stem 208 of the container 104, the first spring 424 compresses and/or bends between the first arm 400 and the housing 106 and the second spring 426 compresses and/or bends between the second arm 402 and the housing 106.

The trigger 108 includes a first contact surface 430 and a second contact surface 432. The first contact surface 430 and the second contact surface 432 are defined by undersides 434, 436 of the first arm 400 and the second arm 402, respectively. In the illustrated embodiment, the first contact surface 430 and the second contact surface 432 are curved such that the first contact surface 430 and the second contact surface 432 are cams. As described in greater detail below, the first contact surface 430 and the second contact surface 432 engage (e.g., contact) the manifold 600 (see FIG. 10) to move the manifold 600 toward the container 104, which actuates the valve stem 208 of the container 104. Turning again to FIG. 5, a second or lower end 438 of the grip portion 300 moves toward the first sidewall 306 and the container 104 (see FIG. 2) to move the first contact surface 430 and the second contact surface 432 into engagement with the manifold 600. In the illustrated embodiment, a thickness of the grip portion 300 decreases or changes from the first end 310 to the second end 438 of the grip portion 300. For example, a first thickness of the grip portion 300 at the first end 310 may be about 1.6 millimeters; a second thickness of the grip portion 300 at the second end 438 may be about 0.7 millimeters. Thus, the second thickness may be less than the first thickness. In other embodiments, the grip portion 300 has other thicknesses.

Figure 6:
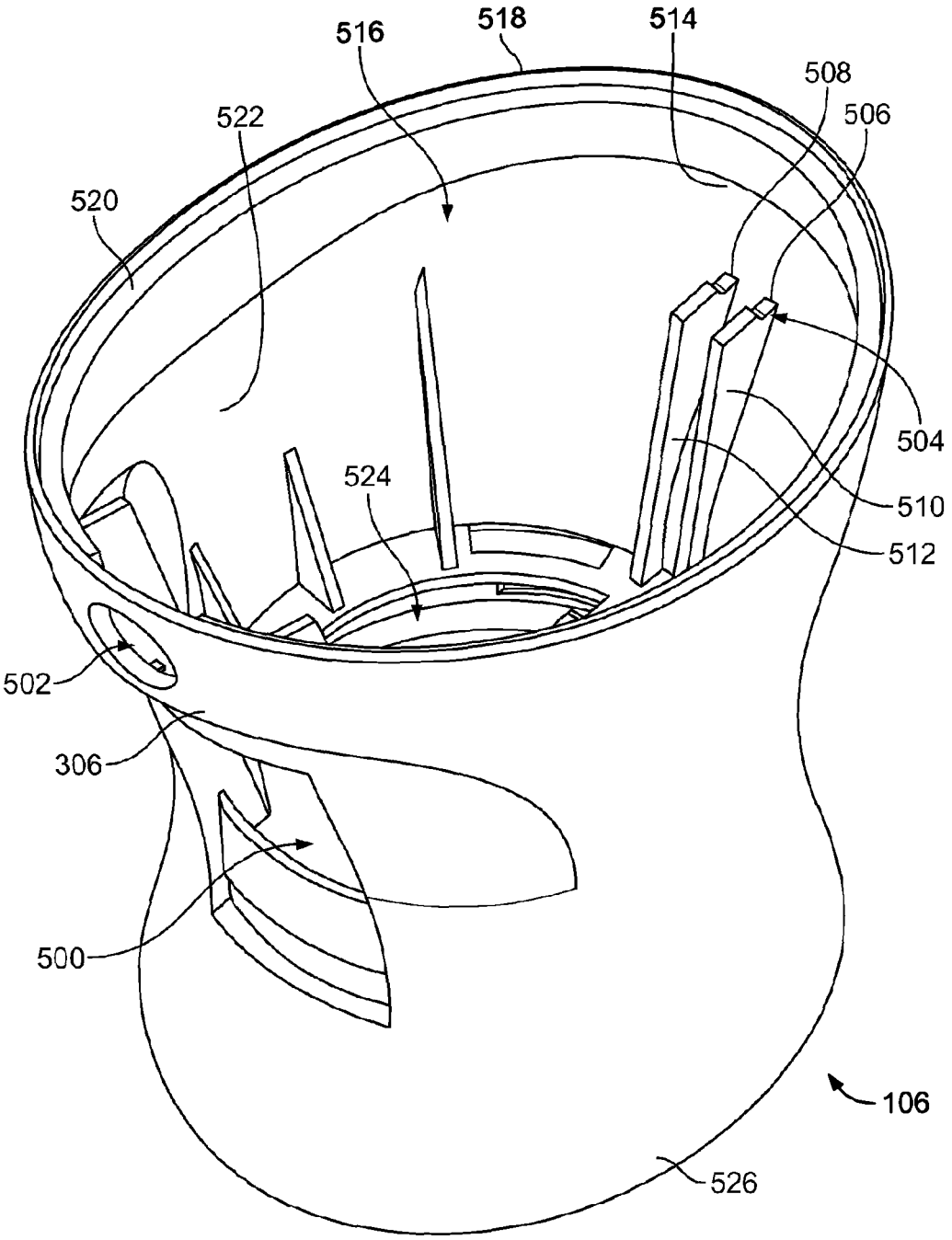
FIG. 6 is a front, top isometric view of a housing of the overcap of FIG. 3.

FIG. 6 is a top, isometric view of the housing 106 of FIGS. 1 and 3. In the illustrated embodiment, the first sidewall 306 of housing 106 defines a first aperture 500 and a second aperture 502. The first aperture 500 is rectangular. In other embodiments, the first aperture 500 is other shapes. In the illustrated embodiment, the housing 106 includes a fulcrum 504. The fulcrum 504 of FIG. 6 is defined by a first notch 506 and a second notch 508 of a first rib 510 and a second rib 512, respectively. The ribs 510, 512 are disposed on a second sidewall 514 of the housing 106 opposite the first sidewall 306. In other embodiments, the fulcrum 504 is defined by one or more additional and/or alternative hinging, rotatable or pivotable structures, e.g., a living hinge, could be used in lieu of, or in addition to, the fulcrum 504. As described in greater detail below with reference to FIG. 12, the first aim 400 and the second aim 402 extend through the first aperture 500 such that the pivot 408 rests on and/or is supported by the fulcrum 504.

The second aperture 502 of the housing 106 of FIG. 6 is circular. In other embodiments, the second aperture 502 is other shapes. The second aperture 502 receives the spray insert 112 and/or a second end portion 604 the manifold 600 (see FIG. 10). However, as described in greater detail below with reference to FIG. 12, the housing 106 does not directly support the spray insert 112 or the manifold 600. The housing 106 includes a third aperture 516 defined by a top or first end 518 of the housing 106. A flange or rim 520 is disposed in an interior 522 of the housing 106 adjacent the first end 518. The rim 520 supports the cap 110 (see FIGS. 1 and 3). The housing 106 also includes a fourth aperture 524 defined by a bottom or second end 526 of the housing 106 opposite the first end 518.

Figure 7:
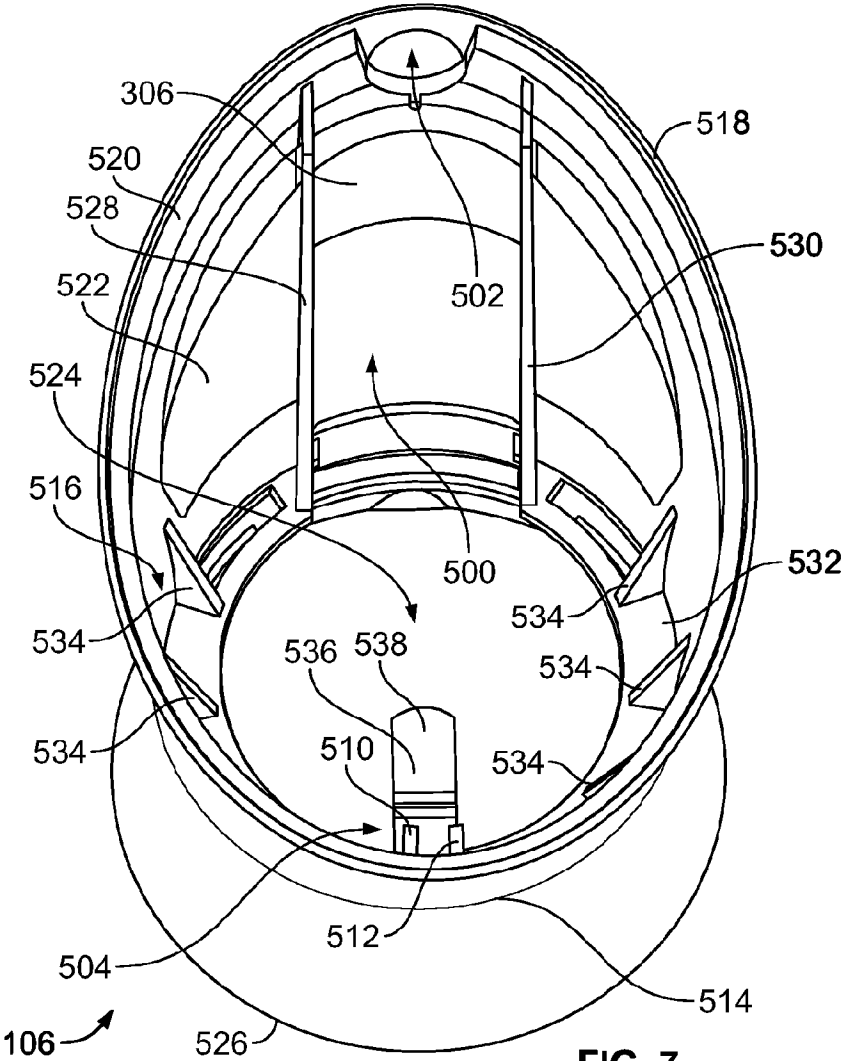
FIG. 7 is rear, top isometric view of the housing of FIG. 6.

FIG. 7 is a top, rear view of the housing 106 of FIG. 6. In the illustrated embodiment, the housing 106 includes a third rib 528 and a fourth rib 530 disposed on the first sidewall 306. The third rib 528 and the fourth rib 530 extend from a second flange 532 toward the first end 518 of the housing 106 to provide rigidity to the housing 106. In some embodiments, the first rib 528 and the second rib 530 support the cap 110. The second flange 532 is spaced apart from the first end 518 and the second end 526 of the housing 106. In the illustrated embodiment, a plurality of braces 534 provides rigidity to the second flange 532. As described in greater detail below with reference to FIG. 8, the second flange 532 may rest on and/or contact the mounting cup 200 of the container 104. In the illustrated embodiment, a cantilevered tongue 536 having a top surface 538 extends from the second sidewall 514 toward the first sidewall 306. In some embodiments, the tongue 536 facilitates molding of the housing 106.

Figure 8:
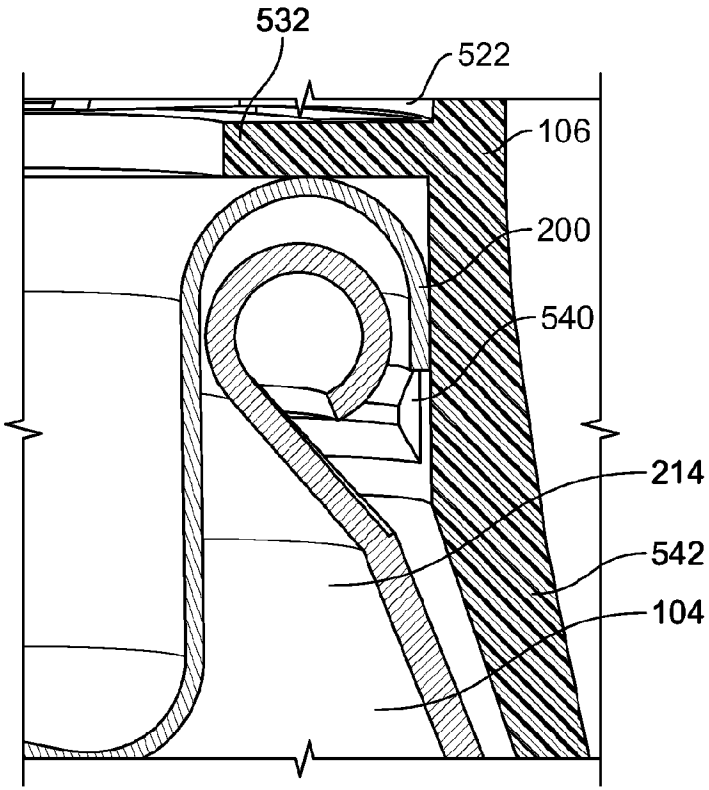
FIG. 8 is an enlarged, partial cross-sectional view taken along line 8-8 of FIG. 1 showing the housing of FIGS. 6 and 7 coupled to the container of FIG. 2.

With reference to FIG. 8, the housing 106 receives a portion of the container 104 via the fourth aperture 524 (see FIGS. 6 and 7). In the illustrated embodiment, the mounting cup 200 is snap fit between the second flange 532 and a plurality of protrusions 540 disposed about the interior 522 of the housing 106 adjacent a skirt 542 of the housing 106. Thus, the second flange 532 and the protrusions 540 contact the mounting cup 200 of the container 104 to secure the overcap 102 to the container 104. In other embodiments, the housing 106 couples to the container 104 in other ways such as, for example, via one or more mechanical and/or chemical fasteners. In the illustrated embodiment, each of the protrusions 540 has a trapezoidal cross-sectional shape. In other embodiments, one or more of the protrusions 540 has a different shape.

Figure 9:
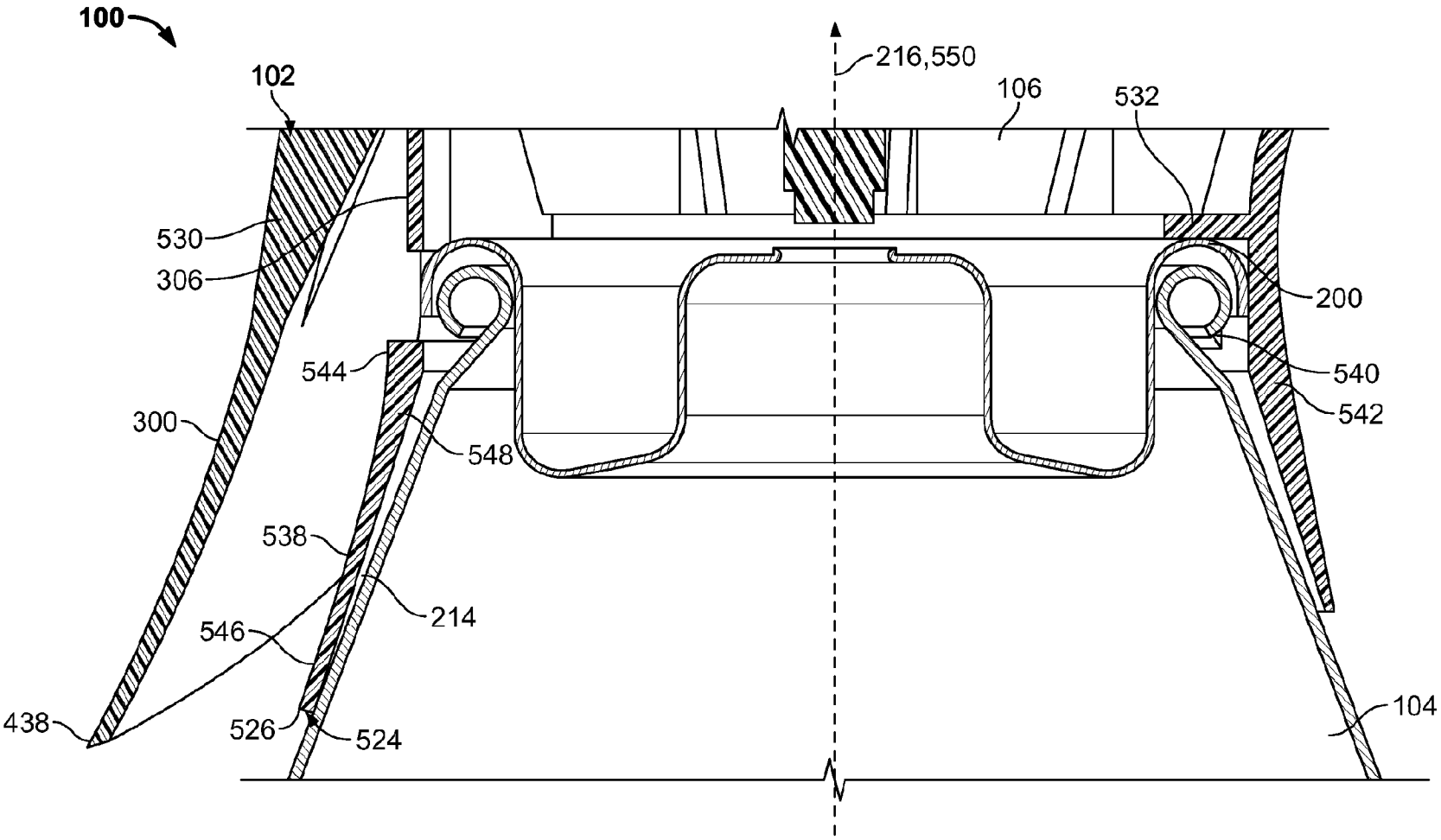
FIG. 9 is a cross-sectional view taken along line 9-9 of FIG. 1 showing the overcap of FIG. 3 coupled to the container of FIG. 2, which is shown schematically for purposes of clarity.

FIG. 9 is a cross-sectional view of the overcap 102 and the container 104. In the illustrated embodiment, the skirt 542 decreases in thickness from an area 544 adjacent the mounting cup 200 toward the second end 526. For example, in the illustrated embodiment, the area 544 has a thickness of about 1.2 millimeters, and the second end 526 has a thickness of about 0.6 millimeters. However, the foregoing dimensions are merely examples and, thus, other dimensions may be employed without departing from the scope of this disclosure. For example, in some embodiments, the area 544 has a thickness of about 1.1 to about 1.6 millimeters and the second end 526 has a thickness of about 0.3 to about 1.0 millimeters. In some embodiments, the second end 526 has a thickness of about 0.3 to about 0.6 millimeters. In some embodiments, the ratio of the thickness of the area 544 to the thickness of the second end 526 is greater than 1:1, or greater than 1.5:1, or greater than 2:1, or greater than 3:1, or greater than 4:1, or greater than 5:1. In some embodiments, the thickness of the area 544 and/or the second end 526 may be variable about a circumference thereof and, in such a scenario, the aforementioned thicknesses are illustrative of the narrowest or thinnest portions of the area 544 and the second end 526.

In the embodiment of FIG. 9, the skirt 542 has a cross-sectional shape bounded by an exterior face 546 of the skirt 542, an interior face 548 of the skirt 542, and the second end 526 of the housing 106. The exterior face 546 of the skirt 542 curves or bows outward from the area 544 and, thus, away from a longitudinal axis 550 of the dispensing system 100. The interior face 548 extends from the area 544 away from the longitudinal axis 550 and is angled, sloped, and/or bowed toward the exterior face 546. As a result, the interior face 548 and the exterior face 546 converge and, thus, the thickness of the skirt 542 decreases from the area 544 adjacent the mounting cup 200 toward the second end 526 of the housing 106. In the illustrated embodiment, the interior face 548 substantially follows or matches a contour of a portion of the neck 214 of the container 104. In some embodiments, the skirt 542 elastically deforms when the overcap 102 is coupled to the container 104 to enable a shape and a size of the skirt 542 to substantially conform to a shape and a size of the neck 214 of the container 104. For example, the skirt 542 in an uncoupled or first state may have a first shape (e.g., circular, oval, etc.) and define the fourth aperture 524 with a first size (e.g., a first diameter) when the overcap 102 is not coupled to the container 104. When the overcap 102 is coupled to the container 104, the skirt 542 may elastically deform to a coupled or second state in which the skirt 542 has a second shape different than the first shape and/or defines the fourth aperture 524 with a second size larger than the first size to substantially conform to the shape and the size of the neck 214 of the container 104. For example, the skirt 542 may bend outwardly and/or expand to substantially conform to the shape and the size of the neck 214 of the container 104. In some embodiments, the elastic deformation of the skirt 542 enables the skirt 542 to form an interference fit or a press fit between the container 104 and the skirt 542. In some embodiments, the elastic deformation of the skirt 542 enables the skirt 542 to form a circumferential fluid seal between the skirt 542 and the container 104. In addition, the minimal thickness of the second end 526 of the skirt 542 provides a substantially smooth transition between the container 104 and the overcap 102 that is more comfortable to a user gripping the dispensing system 100 than traditional dispensing systems employing an overcap. In some embodiments, the elastic deformation of the skirt 542 enables the overcap 102 to form an interference fit and/or a fluid seal on containers having different shapes or sizes than the container 104 of FIG. 9 and provides a substantially smooth transition between the respective containers and the skirt 542.

Figure 10:
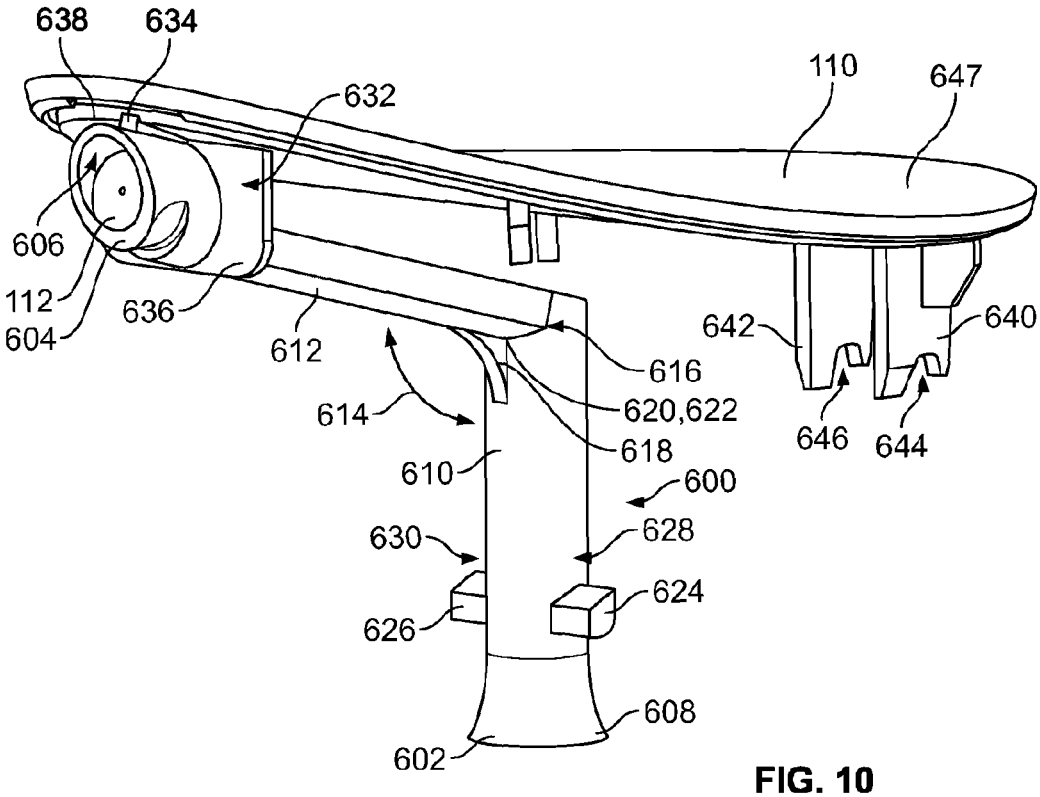
FIG. 10 is a front, isometric view of a manifold and a cap of the overcap of FIG. 3.

FIG. 10 is a front, isometric view of the cap 110 and the manifold 600. In the illustrated embodiment, the manifold 600 includes a first end portion 602 and a second end portion 604. The second end portion 604 of FIG. 10 has an orifice 606 to receive the spray insert 112. The first end portion 602 fluidly couples to the valve stem 208 (see FIG. 2) of the container 104. In the illustrated embodiment, the first end portion 602 includes a flared portion 608. The manifold 600 includes a first duct 610 and a second duct 612. The first duct 610 of FIG. 10 is generally transverse to the second duct 612. For example, the first duct 610 and the second duct 612 may be oriented such that the first duct 610 extends at an angle 614 of about 105 degrees relative to the second duct 612. In some embodiments, the angle 614 is about 90 to about 130 degrees. In other embodiments, the angle 614 is other numbers of degrees. The first duct 610 is coupled to the second duct 612 via a first joint 616. In the illustrated embodiment, the first joint 616 includes a brace 618. The brace 618 of FIG. 10 is an arched plate having a vertex 620 substantially coincident with a junction 622 of the first duct 610 and the second duct 612. In other embodiments, the brace 618 has other shapes and/or configurations. For example, the brace 618 may be a curved beam, a triangular plate, a rectangular beam, and/or other shapes and/or configurations. In some embodiments, the joint 614 does not include the brace 618.

In the illustrated embodiment, a first protrusion 624 and a second protrusion 626 extend from the first duct 610 of the manifold 600. In the illustrated embodiment, the first protrusion. 624 and the second protrusion 626 are disposed on opposite sides 628, 630 of the first duct 610 adjacent the first end portion 602. As described in greater detail below with reference to FIG. 11, the first contact surface 430 of the trigger 108 engages the first protrusion 624, and the second contact surface 432 of the trigger 108 engages the second protrusion 626 to drive the first end portion 602 of the manifold 600 toward the container 104 to depress and actuate the valve stem 208.

In the illustrated embodiment, the manifold 600 is suspended from the cap 110. For example, the second end portion 604 of the manifold 600 is coupled to the cap 110 via a second joint 632. In the illustrated embodiment, the second joint 632 includes a link 634 and a plate 636. In the illustrated embodiment, the cap 110, the link 634, the plate 636, and the manifold 600 are integrally formed and/or unitary. In other embodiments, the cap 110, the link 634, the plate 636 and/or the manifold 600 are coupled in other ways. In the illustrated embodiment, the link 634 is an elongated bar disposed between the second end portion 604 and an interior face 638 of the cap 110 and extends in substantially the same direction as the second duct 612. The plate 636 of FIG. 10 is transverse to the second duct 612, and the second duct 612 extends through the plate 636.

Figure 12:
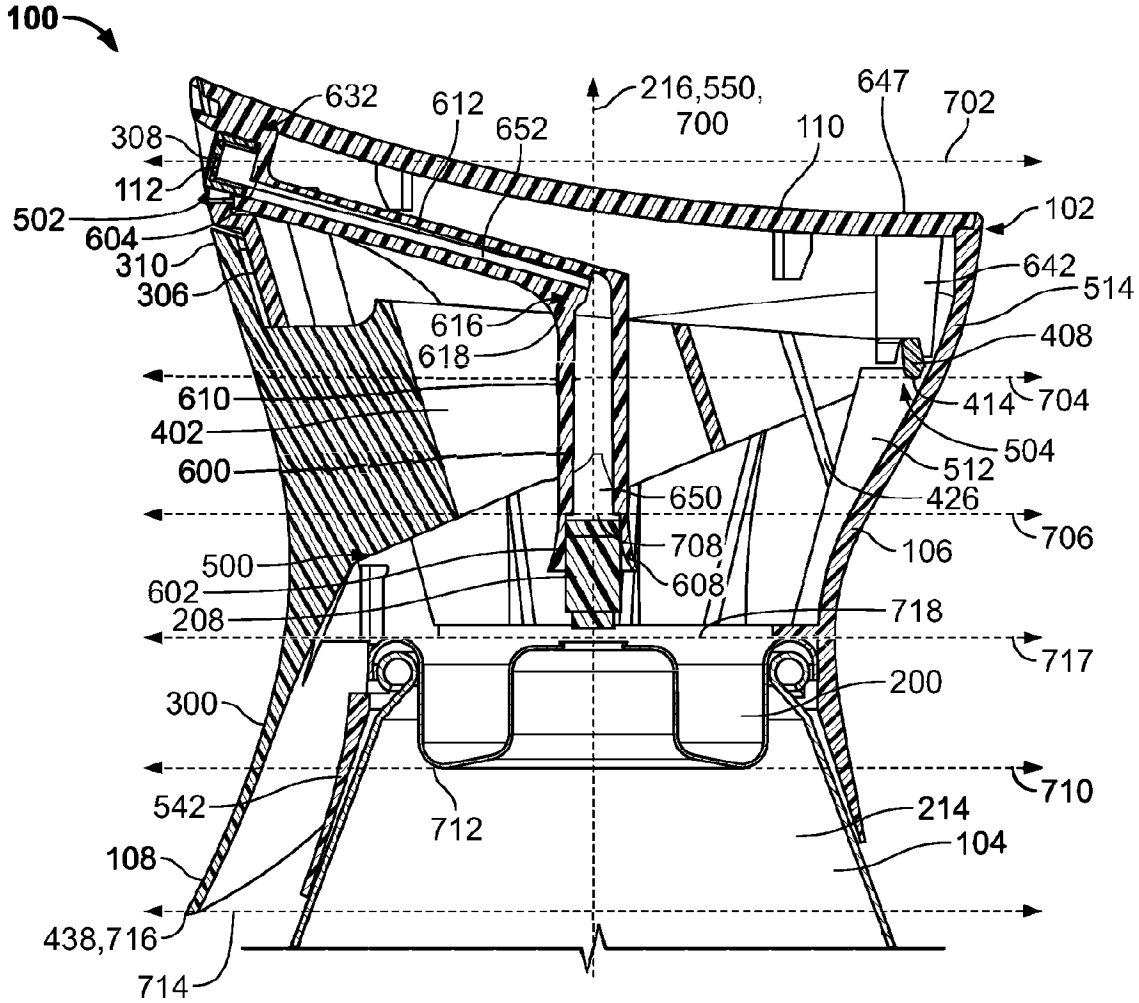
FIG. 12 is a cross-sectional view taken along line 12-12 of FIG. 1 showing the trigger of FIGS. 4 and 5 is a first or unactuated position.

The example cap 110 of FIG. 10 includes a first support 640 and a second support 642 suspended from the interior surface 638. In some embodiments, the first support 640 and the second support 642 are disposed adjacent and/or in contact with the first rib 510 and the second rib 512 (see FIG. 6) of the housing 106. The first support 640 includes a third notch 644, and the second support 642 includes a fourth notch 646. In some embodiments, the third notch 644 and the fourth notch 646 cooperate with the first notch 506 and the second notch 508 (see FIG. 6) of the first rib 510 and the second rib 512, respectively. For example, the pivot 408 (see FIGS. 4 and 5) of the trigger 108 may be disposed in the notches 506, 508, 644, 646 and captured between the ribs 510, 512 and the supports 640, 642, as shown in FIG. 12. The cap 110 includes an exterior or top surface 647.

Figure 11:
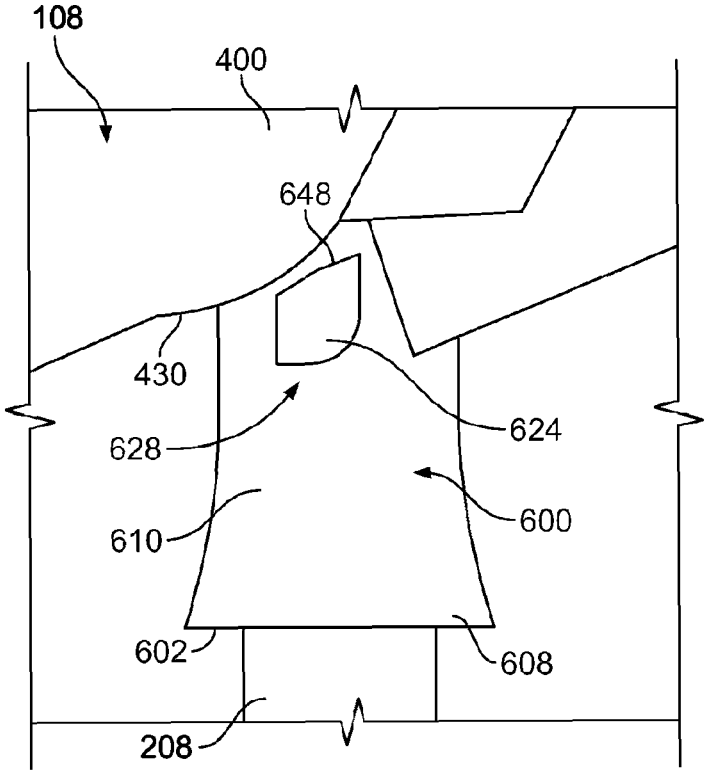
FIG. 11 is an enlarged side view of a valve stem of the container of FIG. 2 in fluid communication with the manifold of FIG. 10.

FIG. 11 is a side view of the trigger 108 in an unactuated or first position in which the first contact surface 430 of the trigger 108 is spaced apart from the first protrusion 624 of the manifold 600. In the illustrated embodiment, the valve stem 208 is received in the first end portion 602 of the manifold 600 to fluidly couple the valve stem 208 and, thus, the container 104 to the manifold 600. In the illustrated embodiment, the first contact surface 430 is convex. The first protrusion 624 includes an engaging surface 648 facing toward the first contact surface 430. In the illustrated embodiment, the engaging surface 648 is an angled or ramp surface oriented such that the first end portion 602 of the manifold 600 moves toward the container 104 (i.e., downward in the orientation of FIG. 11) when the first contact surface 430 engages the engaging surface 648. The second protrusion 626 of the manifold 600 is a mirror image of the first protrusion 624. Therefore, the foregoing description of the first protrusion 624 is applicable to the second protrusion 626. To avoid redundancy, the second protrusion 626 is not separately described.

FIG. 12 is a cross-sectional view of the example dispensing system 100 of FIGS. 1-11 illustrating the trigger 108 operatively coupled to the container 104. In the embodiment of FIG. 12, the trigger 108 is in the unactuated or first position. The grip portion 300 of the trigger 108 is disposed outside of the housing 106 of the overcap 102. The first arm 400 and the second arm 402 extend through the first aperture 500 of the first sidewall 306, and the pivot 408 is pivotably coupled to the second sidewall 514 via the fulcrum 504. In the illustrated embodiment, the pivot 408 is disposed and/or captured between the first rib 510 and the first support 640, and the pivot 408 is disposed and/or captured between the second rib 512 and the second support 642.

The cap 110 is coupled to the housing 106, and the manifold 600 is suspended within the housing 106 from the cap 110. In the illustrated embodiment, the manifold 600 is oriented relative to the housing to align the second end portion 604 of the manifold 600 and, thus, the discharge outlet 308 of the spray insert 112 with the second aperture 502 of the first sidewall 306 of the housing 106. However, in the illustrated embodiment, the housing 106 does not directly support the second end portion 604 of the manifold 600. For example, the second end portion 604 may disposed within the second aperture 502 and spaced apart from the first sidewall 306. In other embodiments, the housing 106 supports the second end portion 604 of the manifold 600 and/or limits movement of the second end portion 604 of the manifold 600 during actuation of the trigger 108.

The first end portion 602 of the manifold 600 is disposed over the valve stem 208, and the valve stem 208 is received in a first fluid passageway 650 of the first duct 610. In some embodiments, when the trigger 108 is in the first position as shown in FIG. 12, the first end portion 602 of the manifold 600 does not sealingly engage the valve stem 208. For example, the first end portion 602 may be spaced apart from the valve stem 208 or in contact with the valve stem 208 without sufficient pressure to sealingly engage the valve stem 208. In other embodiments, the valve stem 208 is in sealing engagement with the manifold 600 in the first position. The first fluid passageway 650 is in fluid communication with a second fluid passageway 652 of the second duct 612 of the manifold 600, and the second fluid passageway 652 is in fluid communication with the discharge outlet 308 of the spray insert 112.

In the illustrated embodiment, the central, longitudinal axis 216 of the container 104, a central, longitudinal axis 700 of the valve stem 208, and the central, longitudinal axis 550 of the dispensing system 100 are substantially collinear. A first plane 702 perpendicular to the longitudinal axis 550 of the dispensing system 100 passes through the discharge outlet 308 of the spray insert 112. A second plane 704 perpendicular to the longitudinal axis 550 passes through the axis of rotation 414 of the trigger 108. A third plane 706 perpendicular to the longitudinal axis 550 of the dispensing system 100 passes through the first end portion 602 of the manifold 600. In the illustrated embodiment, the third plane 706 passes through the first end portion 602 of the manifold 600 and an uppermost point or tip 708 of the valve stem 208. As used in this disclosure, an uppermost point or tip of a valve stem is a point of the valve stem extending outside of a container and disposed farthest away from the container in a direction along a longitudinal axis of the valve stem. A fourth plane 710 perpendicular to the longitudinal axis 550 of the dispensing system 100 passes through a lowermost point 712 of the mounting cup 200. As used in this disclosure, a lowermost point of a mounting cup is a point of the mounting cup disposed within a container and farthest away from an end of the container on which the mounting cup is supported in a direction along a longitudinal axis of the container. A fifth plane 714 perpendicular to the longitudinal axis 550 of the dispensing system 100 passes through a lowermost point 716 of the grip portion 300 of the trigger 108. As used in this disclosure, a lowermost point of a grip portion of a trigger is a point of the grip portion of the trigger that is closest to a bottom end or base (e.g., the second end 210) of a container in a direction along a longitudinal axis of the container. A sixth plane 717 perpendicular to the longitudinal axis 550 of the dispensing system 100 passes through an uppermost point 718 of the container 104. An uppermost point of the container is a point of the container that is farthest away from a bottom end or base of the container in a direction along a longitudinal axis of the container. In the illustrated embodiment, the uppermost point 718 of the container 104 IS disposed on the mounting cup 200.

In the illustrated embodiment, the second plane 704 is disposed between the first plane 702 and the third plane 706. Thus, when the dispensing system 100 is in an upright position as shown in FIG. 12, the discharge outlet 112 is disposed above the axis of rotation 414 of the trigger 108, and the axis of rotation 414 of the trigger 108 is disposed above the tip 708 of the valve stem 208. Further, the axis of rotation 414 of the trigger 108 is disposed on an opposite side of the longitudinal axis 550 of the dispensing system 100 as the discharge outlet 308. In addition, the grip portion 300 of the trigger 108 is disposed on the same side of the longitudinal axis 550 of the dispensing system 100 as the discharge outlet 308.

In the illustrated embodiment, the fifth plane 714 is disposed below the fourth plane 710. Thus, the lowermost point 716 of the grip portion 300 of the trigger 108 is disposed below the lowermost point 712 of the mounting cup 200. As described in greater detail below with reference to FIG. 18, an entire footprint of the overcap 102 is disposed within a footprint of the container 104 even though the grip portion 300 of the trigger 108 extends below the mounting cup 200.

Figure 13:
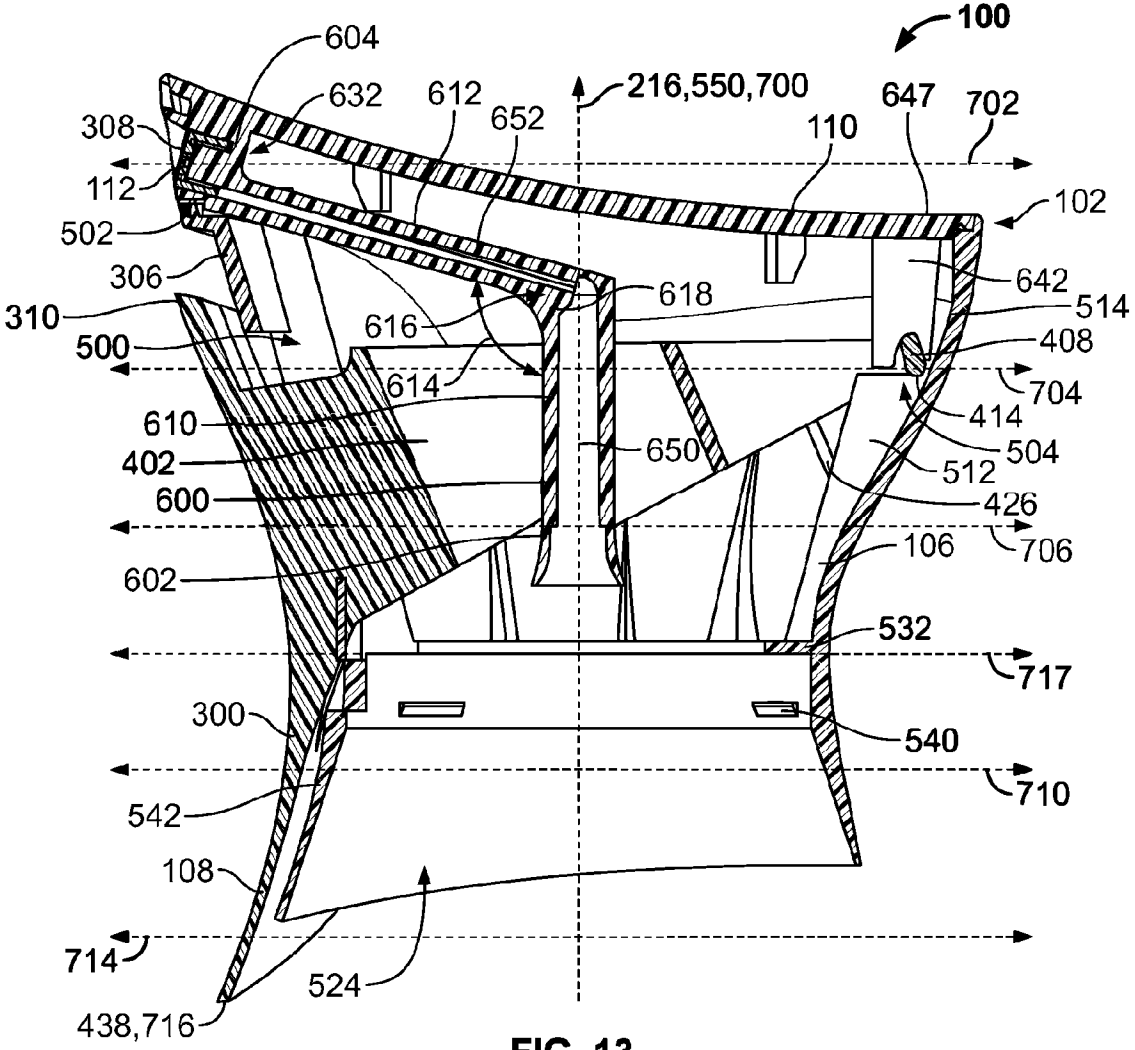
FIG. 13 is a cross-sectional view similar to the one shown in FIG. 12 with the trigger of FIGS. 4 and 5 depicted in a second or actuated position.

FIG. 13 is a cross-sectional view of the overcap 102 of FIG. 12 illustrating the trigger 108 in a second or actuated position. In the illustrated embodiment, when a user squeezes the trigger 108, the trigger 108 pivots about the axis of rotation 414 from the first position to the second position, and the lower end 438 of the grip portion 300 of the trigger 108 moves toward the container 104 to actuate the valve stem 208. In some embodiments, the trigger 108 rotates between about 2 degrees and about 10 degrees to rotate from the first position to the second position. Thus, the trigger may have a total range of movement of about 2 degrees to about 10 degrees of rotation. In some embodiments, the trigger 108 rotates between about 5 degrees and about 7 degrees to rotate from the first position to the second position. Thus, in such embodiments, the trigger has a total range of movement of about 5 degrees to about 7 degrees of rotation. For example, in the illustrated embodiment, the trigger 108 rotates about six degrees to rotate from the first position to the second position. In some embodiments, the grip portion 300 of the trigger 108 contacts the skirt 524 and/or the container 104 when the trigger 108 is in the second position.

When the trigger 108 moves from the first position to the second position (see, e.g., FIG. 13), the first contact surface 430 and the second contact surface 432 of the trigger 108 engage the first protrusion 624 and the second protrusion 626 of the manifold 600, respectively, and drive the first end portion 602 of the manifold toward the container 104. In some embodiments, the first end portion 602 sealingly engages the valve stem 208 as the first end portion 602 moves toward the container 104. As the trigger 108 moves further toward the second position, the first end portion 602 of the manifold 600 depresses the valve stem 208, and the first spring 424 and the second spring 426 compress between the trigger 108 and the housing 106. As a result, a fluid product is dispensed from the container 104 into the first flow passageway 650 via the valve stem 208. The fluid product then flows through the second fluid passageway 652, into the spray insert 112, and out of the discharge outlet 308. When the user releases the trigger 108, the first spring 424 and the second spring 426 urge the trigger 108 to return to the first position shown in FIG. 12.

In the illustrated embodiment, the manifold 600 is flexible or pliable to enable a shape and/or a size of the manifold 600 to change when the trigger 108 drives the first end portion 602 of the manifold 600 toward the container 104. For example, the manifold 600 may elastically deform to bend or flex at the first joint 616, the second joint 632, at one or more areas along the first duct 610, and/or at one or more areas along the second duct 612 to enable the first end portion 602 of the manifold 600 to sealingly engage the valve stem 208 and depress the valve stem 208 while the second end portion 604 is maintained in alignment with the second aperture 502 of the housing 106. Example elastic deformation of the manifold 600 is further described below with reference to FIG. 17.

Figure 14:
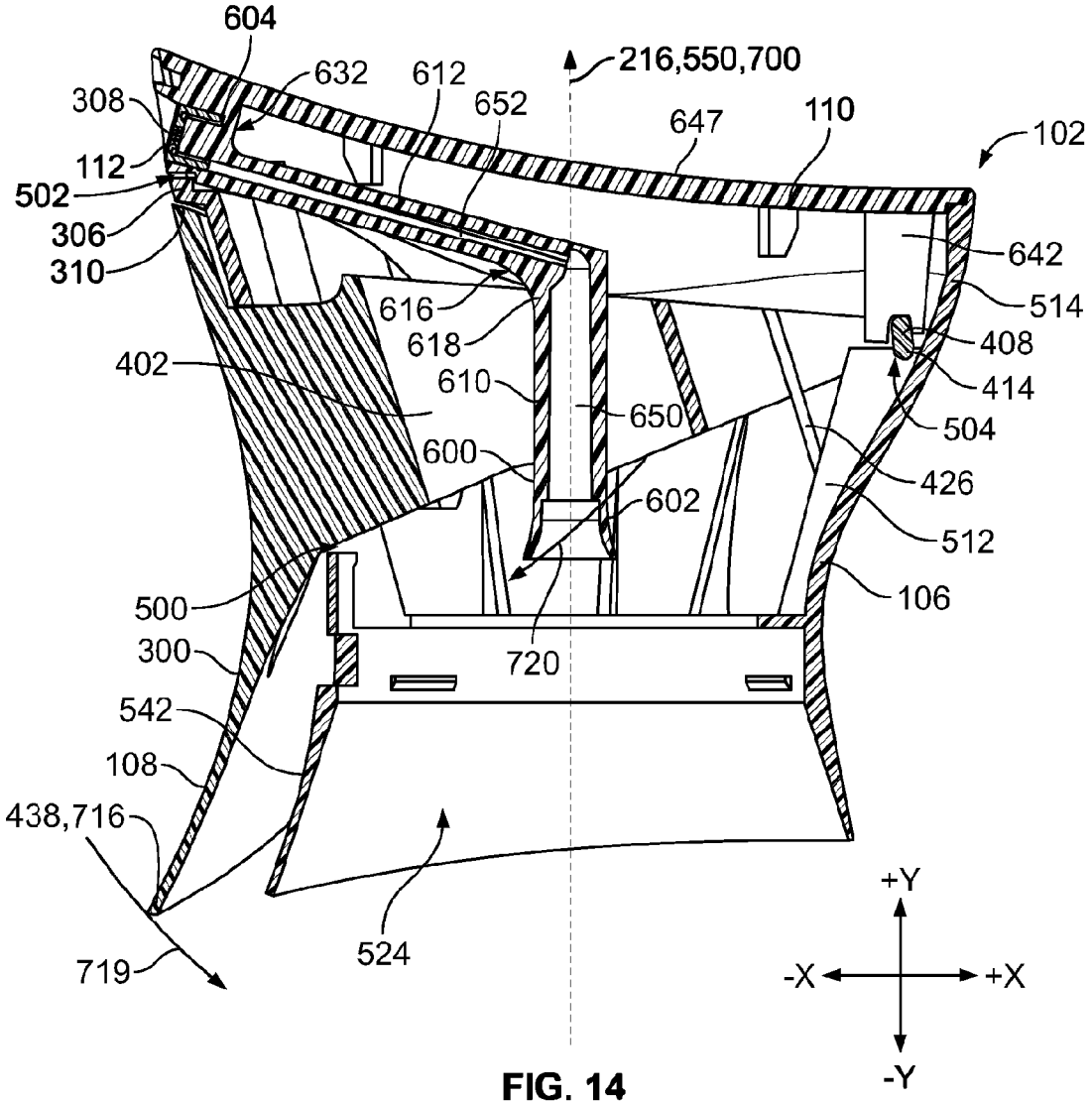
FIG. 14 is a cross-sectional view similar to the one shown in FIG. 12 further depicting arcuate paths of the trigger and the manifold of FIGS. 12 and 13.

FIG. 14 is a cross-sectional view of the overcap 102 of FIG. 12 illustrating the trigger 108 in the first position. In the illustrated embodiment, the lower end 438 and/or the lowermost point 716 of the grip portion 300 of the trigger 108 moves in a first arcuate path 719, and the first end portion 602 of the manifold 600 moves in a second arcuate path 720 when the trigger 108 pivots from the first position (see FIG. 12) to the second position (see FIG. 13). In some embodiments, the first arcuate path 719 and/or the second arcuate path 720 are arcs of a circle. In other embodiments, the first arcuate path 719 and/or the second arcuate path 720 are not arcs of a circle. For example, the first arcuate path 719 and/or the second arcuate path 720 may be parabolic and/or one or more additional and/or alternative shapes. In some embodiments, the first arcuate path 719 has an arc length of about 4 millimeters to about 14 millimeters. In some embodiments, the first arcuate path 719 has an arc length of about 7 millimeters to about 9 millimeters. In the illustrated embodiment, the first arcuate path 719 has an arc length of about 8 millimeters. In other embodiments, the first arcuate path 719 has an arc of other distances.

In the illustrated embodiment, each of the first actuate path 719 and the second arcuate path 720 have horizontal vector components along art X-Axis and vertical vector components along a Y-Axis. In the embodiment of FIG. 14, the Y-Axis is parallel to the longitudinal axis 550 of the dispensing system 100, and the X-Axis is perpendicular to the Y-Axis and the axis of rotation 414 of the trigger 108. As used in this disclosure, vertical vector components having an upward direction are referred to as positive vertical vector components; vertical vector components having a downward direction are referred to as negative vertical vector components; horizontal vector components having a rightward direction are referred to as positive horizontal vector components; and horizontal vector components having a leftward direction are referred to as negative horizontal vector components.

In the illustrated embodiment, the first arcuate path 719 opposes the second arcuate path 720. For example, in the illustrated embodiment, although both the first arcuate path 719 and the second arcuate path 720 have negative vertical vector components, the first arcuate path 719 has a positive horizontal vector component and the second arcuate path 720 has a negative horizontal vector component. Thus, the first arcuate path 719 and the second arcuate path 720 have opposing or opposite horizontal vector components. As a result, in the embodiment of FIG. 14, the lower end 438 of the trigger 108 moves along the first arcuate path 719 in a first direction substantially opposite to a second direction in which the first end portion 602 of the manifold 600 moves along the second arcuate path 720. In the illustrated embodiment, the first direction is substantially counterclockwise in the orientation of FIG. 14, and the second direction is substantially clockwise in the orientation of FIG. 14. As a result, the first end 310 of the grip portion 300 of the trigger 108 moves outward or away from the first sidewall 306 of the housing 106 and the lower end 438 of the grip portion 300 moves toward the container 104 when the trigger 108 rotates from the first position to the second position.

In some embodiments, an arc length of the second arcuate path 720 is about 2 millimeters to about 6 millimeters. In some embodiments, the arc length of the second arcuate path 720 is about 3 millimeters to about 4 millimeters. Thus, the arc length of the second arcuate path 720 may be less than the arc length of the first arcuate path 719. In some embodiments, the negative vertical vector component of the second arcuate path 720 has a magnitude of about 2 millimeters to about 4 millimeters. In the illustrated embodiment, the arc length of the second arcuate path 720 is about 3 millimeters. Thus, the first end portion 602 may have a total travel distance or range of movement in a direction toward the container 104 of about 3 millimeters. In other embodiments, the negative vertical vector component of the second arcuate path 720 is other distances. In some embodiments, the magnitude of the vertical vector component of the second arcuate path 720 is about 1.5 times to about 6 times greater than the magnitude of the horizontal vector component of the second arcuate path Dispensing systems fashioned in the manner as taught herein provide significant advantages over traditional sprayers. The present embodiments provide better alignment and movement between the valve stem 208 and the manifold 600. Because the manifold 600 is fixed to the cap 110 as a single component, a pivot point is created for the manifold 600 to move about. Similarly, the trigger 108 has a pivot point around which it moves as well, wherein the arcuate paths of the trigger 108 and the manifold 600 are opposite one another as noted above. When the structural features of the manifold 600 and trigger 108 connect during an actuation step, the opposing arcuate paths 719, 720 keep the forces on the manifold 600 near vertical. As also noted above, the vertical travel distance is relatively short, which ensures that the travel distance of the structural features along their opposing arcuate paths is relatively flat. Therefore, the force acting on the structural features over the travel range does not substantially change, which allows for a more rigid dispensing system that can translate rotational movement of a user's hand into vertical motion of the valve stem 208 while limiting translation of structural features of the trigger 108 and manifold 600. The trigger 108 may also have less play or lost motion than traditional sprayers with triggers.

Figure 15:
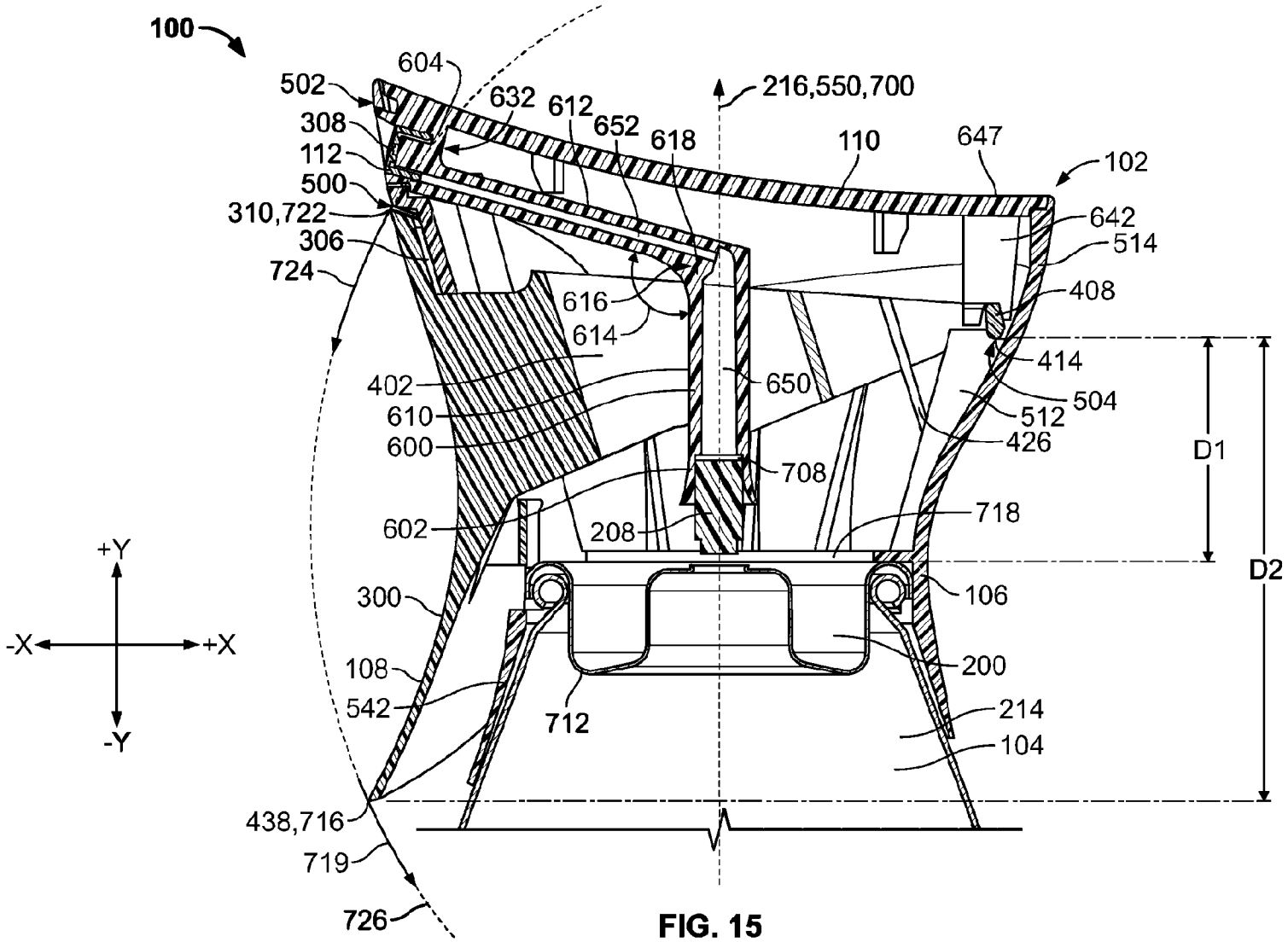
FIG. 15 is a cross-sectional view similar to the one shown in FIG. 1 further showing an arcuate path of the trigger of FIGS. 12-14.

FIG. 15 is a cross-sectional view of the dispensing system 100, which illustrates that an uppermost point 722 of the grip portion 300 of the trigger 108 moves along a third arcuate path 724 when the trigger 108 moves from the first position to the second position. As used in this disclosure, an uppermost point of a grip portion of a trigger is a point of the grip portion farthest away from a lowermost point (e.g., the lowermost point 716) of the grip portion in a direction along a longitudinal axis of a dispensing system on which the trigger is employed (e.g., longitudinal axis 550). In the illustrated embodiment, the third arcuate path 724 of the uppermost point 722 of the grip portion 300 has a magnitude of about 5 millimeters. Thus, the magnitude of the third arcuate path 724 of the uppermost point 722 of the grip portion 300 is less than the magnitude of the first arcuate path 719 of the lowermost point 716 of the grip portion 300 of the trigger 108.

In the illustrated embodiment, the third arcuate path 722 has a negative vertical vector component and a negative horizontal vector component. In some embodiments, the negative vertical vector component has a magnitude of about 4.7 millimeters. In some embodiments, a magnitude of the negative horizontal vector component of the third arcuate path 724 is 0.7 millimeters. Thus, the uppermost point 722 of the grip portion 300 moves outward and away from the longitudinal axis 550 of the dispensing system 100. In other embodiments, the magnitudes of the vertical vector component and/or the horizontal vector component of the third arcuate path 724 are other distances. As described in greater detail below with reference to FIG. 16, the outward movement of the uppermost point 722 of the grip portion 300 enables the grip portion 300 to shield a hand of a user gripping the overcap 102 from fluid product, if any, dripping from the discharge outlet 308.

With reference still to FIG. 15, the grip portion 300 of the trigger 108 is sized, shaped, and/or dimensioned such that the first arcuate path 719 and the third arcuate path 724 lie on the same circle 726. Thus, the uppermost point 722 of the grip portion 300 and the lowermost point 716 of the grip portion 300 follow substantially the same trajectory when the trigger 108 moves from the first position to the second position. In other embodiments, the uppermost point 722 of the grip portion 300 and the lowermost point 716 do not follow the same trajectory.

With continued reference to FIG. 15, when the trigger 108 is in the first position, a first distance D1 along the Y-axis from the axis of rotation 414 of the trigger 108 to the uppermost point 718 of the container 104 is about 19 millimeters to about 21 millimeters. In some embodiments, the first distance D1 is about 10 millimeters to about 35 millimeters. A second distance D2 along the Y-axis from the axis of rotation 414 of the trigger 108 and the lowermost point 716 of the grip portion 300 of the trigger is about 39 millimeters to about 41 millimeters. In some embodiments, the second distance D2 is about 30 millimeters to about 50 millimeters. However, the above-noted dimensions are merely examples and, thus, other dimensions may be used without departing from the scope of this disclosure.

Figure 16:
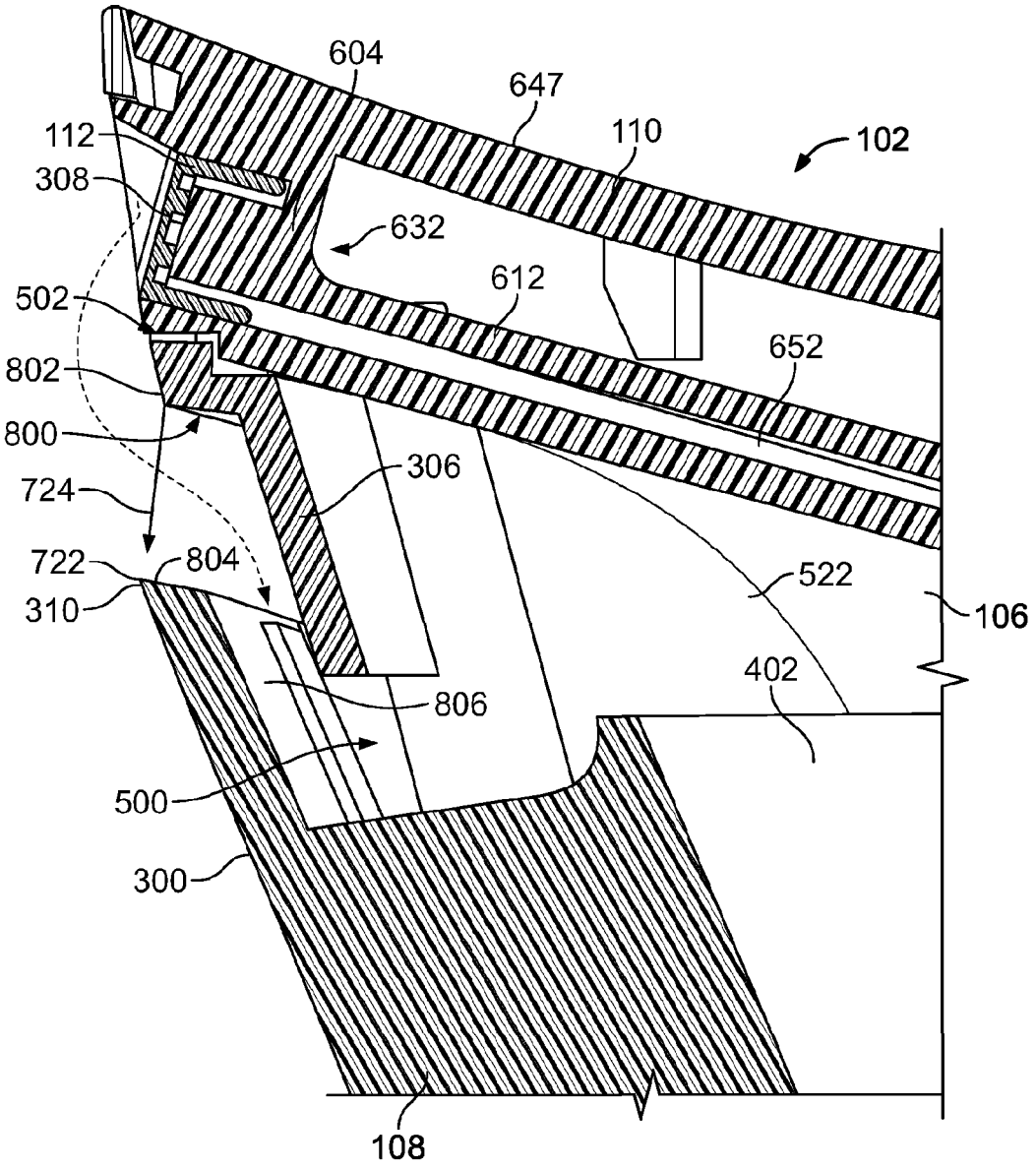
FIG. 16 is an enlarged cross-sectional view of a portion of FIG. 12 depicting a rail of the overcap of FIG. 3.

FIG. 16 is a cross-sectional view of the overcap 102 illustrating the trigger 108 in the actuated or second position. In the illustrated embodiment, the first sidewall 306 of the housing 106 includes a rail 800. In the illustrated embodiment, the rail 800 is an inwardly stepped and/or sloped surface 802 extending from the second aperture 502 to the first aperture 500 of the first sidewall 306. In the illustrated embodiment, during and/or after a fluid product is dispensed from the discharge outlet 308, residual amounts of the fluid product may collect on or near the discharge outlet 308 and drip and/or flow downward in the orientation of FIG. 16. In some embodiments, surface tension of the fluid product urges the fluid product to cohere to and/or remain in contact with the rail 800 as the fluid product flows downward. As a result, the rail 800 directs the fluid product into the housing 106 via the first aperture 500. Thus, the example rail 800 of FIG. 16 may prevent or limit residual drippings of the fluid product from contacting the hand of the user gripping the dispensing system 100.

In some embodiments, some of the residual fluid does not cohere to the rail 800 and falls or drips from the discharge outlet 308. In the illustrated embodiment, because the uppermost point 722 of the grip portion 300 of the trigger 108 moves outward (e.g., to the left in the orientation of FIG. 16) when the trigger 108 moves from the first position to the second position, an upper surface 804 and/or an interior surface 806 of the grip portion 300 catches the fluid product (i.e., the falling or dripping fluid product lands on the upper surface 804 and/or the interior surface 806) and directs the fluid product into the housing 106. In the embodiment of FIG. 16, the uppermost point 722 of the grip portion 300 is disposed farther outward from the longitudinal axis 550 of the dispensing system 100 than the discharge outlet 308 when the grip portion 300 is in the second position. In the illustrated embodiment, the upper surface 804 and the interior surface 806 are slanted, sloped and/or angled toward the interior 522 of the housing 106 to direct the fluid product into the housing 106.

Figure 17:
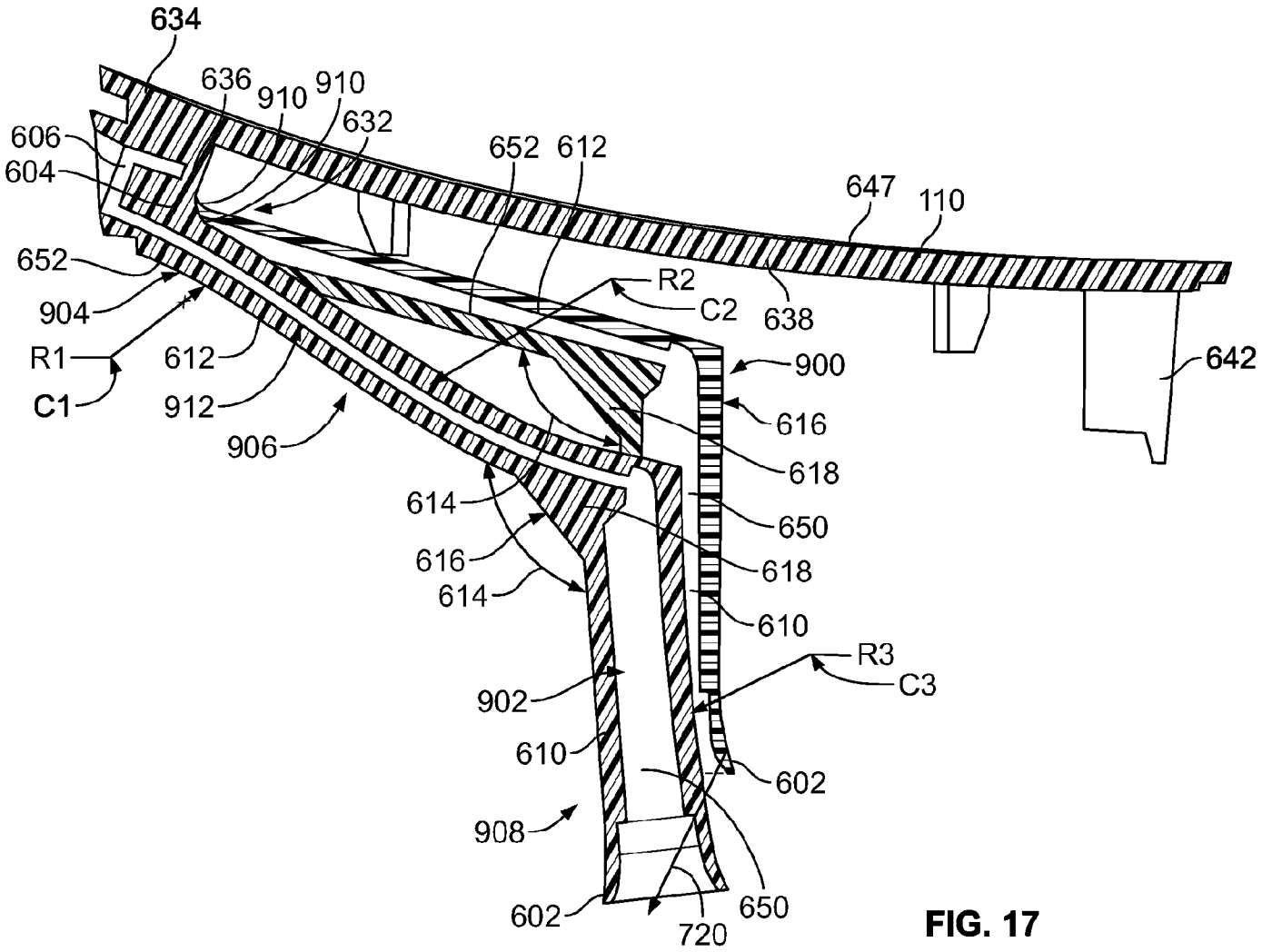
FIG. 17 is a cross-sectional view of the manifold of FIG. 12 shown schematically in a first state depicted in conjunction with a schematic representation of the manifold in a second state.

FIG. 17 is a cross-sectional, schematic view of the manifold 600 of FIG. 6 when the manifold 600 is in a first or unactuated state 900 and a second or actuated second state 902. In the illustrated embodiment, the manifold 600 is in the first state 900 when the trigger 108 is in the first position. In the illustrated embodiment, when the manifold 600 is in the first state, the first duct 610 and the second duct 612 are substantially straight. In other embodiments, the first duct 610 and/or the second duct 612 are in other configurations (e.g., curved) when the trigger 108 is in the first position.

The manifold 600 is in the second state when the trigger 108 is in the second position. In the illustrated embodiment, when the trigger 108 engages the manifold 600 via the protrusions 624, 626 (see FIG. 10) extending from the first duct 610, the trigger 108 applies force to the manifold 600 that elastically deforms the manifold 600. For example, in the illustrated embodiment, the manifold 600 flexes or bends relative to the cap 110 at the second joint 632, at a first flexure area 904 of the second duct 612, at a second flexure area 906 of the second duct 612, at the first joint 616, and at a third flexure area 908 of the first duct 610. As a result, the first end portion 602 of the manifold 600 moves along the second arcuate path 720. In the illustrated embodiment, the first end portion 602 of the manifold 600 moves toward the container 104 (i.e. downward in the orientation of FIG. 17) and toward the grip portion 300 of the trigger 108 (i.e., leftward in the orientation of FIG. 17) when the manifold 600 elastically deforms from the first state 900 to the second state 902.

In the illustrated embodiment, the housing 106 substantially prevents elastic deformation of the cap 110 when the trigger 108 moves from the first position to the second position. For example, the first flange 520 (see FIGS. 6 and 7), the third rib 528 (see FIG. 7), and the fourth rib 530 (see FIG. 7) support the cap 110 adjacent the second end portion 604 of the manifold 600 to provide rigidity to the cap 110 and substantially prevent the cap 110 from elastically deforming (e.g., bending) when the trigger 108 moves from the first position to the second position.

In the illustrated embodiment, the second joint 632 elastically deforms such that an elbow or junction 910 between the second end portion 604 and the second duct 612 straightens (i.e., a radius of curvature of the elbow 910 increases). The first flexure area 904 extends from the second joint 632 toward the first joint 616 of the manifold 600. The second duct 612 over the first flexure area 904 is curved about a first center of curvature C1 and has a first radius of curvature R1. In some embodiments, the first flexure area 904 extends along about half of a length of the second duct 612.

The second flexure area 906 extends from the first flexure area 904 to the first joint 616 of the manifold 600. The second duct 612 over the second flexure area 906 is curved about a second center of curvature C2 and has a second radius of curvature R2. In the illustrated embodiment, the first center of curvature C1 and the second center of curvature C2 are on opposite sides of the second duct 612. As a result, the first flexure area 904 is concave and the second flexure area 906 is convex. Thus, the second duct 612 in the second state 902 has a point of inflection 912. In some embodiments, the first radius of curvature R1 is equal to the second radius of curvature R2. In other embodiments, the first radius of curvature R1 is different than the second radius of curvature R2. In some embodiments, the second flexure area 906 extends along about half of the length of the second duct 612. In other embodiments, the first flexure area 904 and/or the second flexure area 906 extend over other amounts of the length of the second duct 612.

The first joint 616 elastically deforms such that the first joint 616 straightens and, thus, the angle 614 between the first duct 610 and the second duct 612 increases. In some embodiments, the brace 618 substantially prevents the first joint 616 from deforming and, thus, in some embodiments, the angle 614 in the second state 902 is substantially the same as the angle 614 in the first state 902.

The third flexure area 908 extends from the first joint 616 to the first end portion 602 of the manifold 600. In the illustrated embodiment, the first duct 610 over the third flexure area 908 is curved about a third center of curvature C3 and has a third radius of curvature R3. In the illustrated embodiment, the third center of curvature C3 is on the same side of the manifold 600 as the second center of curvature C2. The third radius of curvature R3 of FIG. 17 is greater than the first radius of curvature R1 and/or the second radius of curvature R2. In other embodiments, the third radius of curvature R3 is equal to or less than the first radius of curvature R1 and/or the second radius of curvature R2. In other embodiments, the manifold 600 elastically deforms in other ways. For example, the manifold 600 may have one or more additional, fewer, and/or alternative flexure areas, points of inflection, etc.

Figure 18:
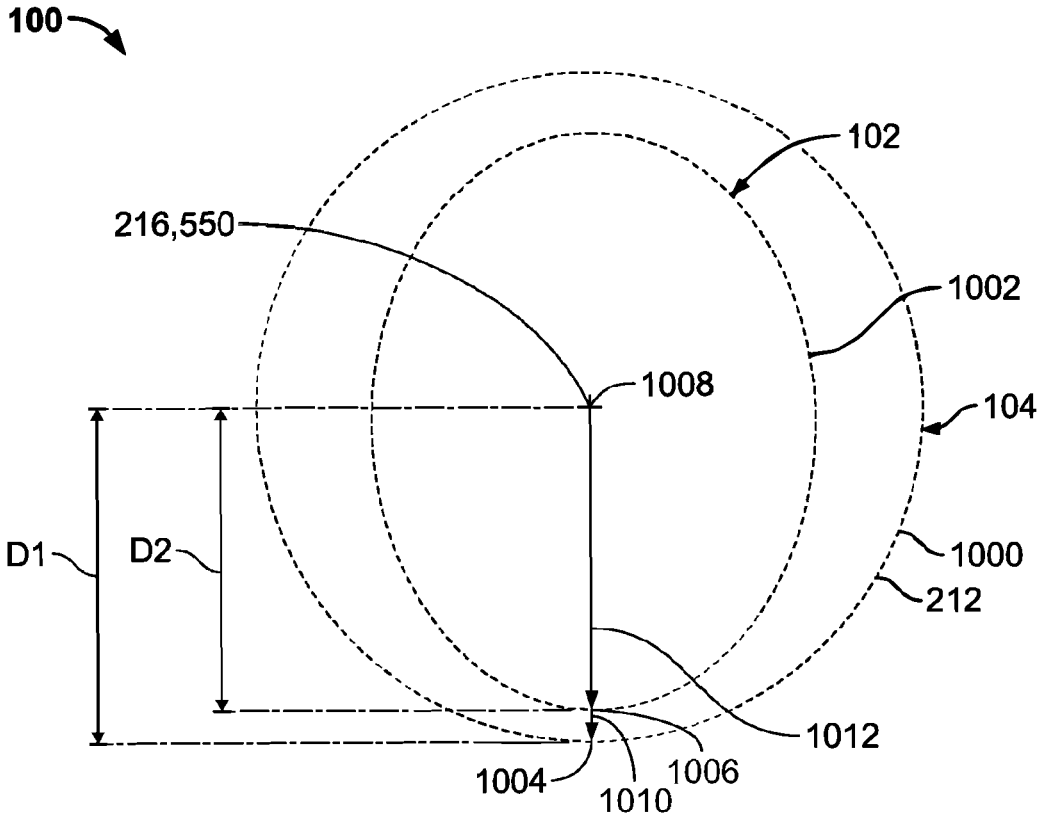
FIG. 18 is a top, schematic view illustrating a first footprint of the container and a second footprint of the overcap of the dispensing system of FIGS. 1-17.

FIG. 18 is a top, schematic view of the dispensing system 100 illustrating an example first footprint 1000 of the container 104 and an example second footprint 1002 of the overcap 102. The first footprint 1000 is a schematic illustration of outermost points of the container 104, including a first outermost point 1004 of the cylindrical portion 212. The second footprint 1002 is a schematic illustration of outermost points of the overcap 102, including a second outermost point 1006 of the trigger 108. As shown in FIG. 18, the second footprint 1002 of the overcap 102 is entirely within the first footprint 1000 of the container 104. Thus, the first footprint 1000 of the container 104 circumscribes the second footprint 1002 of the overcap 102. In the illustrated embodiment, the cylindrical portion 212 of the container 104 has a circular, cross-sectional shape. Thus, in the embodiment of FIG. 18, the first footprint 1000 is circular. In other embodiments, the container 104 and/or the first footprint 1000 may be other shapes.

In the illustrated embodiment, the longitudinal axis 216 of the container 104 passes through a center of curvature 1008 of the cylindrical portion 212 of the container 102. In the embodiment of FIG. 18, the center of curvature 1008 is coincident with a centroid of the container 104. Thus, the longitudinal axis 216 of the container 104 is a central, longitudinal axis of the container. As used in this disclosure, a central, longitudinal axis is a longitudinal axis passing through a center of a cross-sectional shape and/or a centroid of a structure.

In the illustrated embodiment, the first outmost point 1004 of the container 104 is a first distance D1 from the longitudinal axis 216 measured along a first line or radius 1010 perpendicular to the longitudinal axis 216. The second outmost point 1006 of the trigger 108 is a second distance D2 from the longitudinal axis 216 measured along a second line or radius 1012 perpendicular to the longitudinal axis. In the illustrated embodiment, the second line 1012 is coplanar with the first line 1010. In the illustrated embodiment, the first distance D1 is greater than the second distance D2; thus, the second distance D2 is less than the first distance D1. Thus, no portion of the overcap 102, including the grip portion 300, is disposed farther from the longitudinal axis 216 in a direction perpendicular to the longitudinal axis 216 than a distance equal to the first radius 1010 of the cylindrical portion 214. As a result, if the dispensing system 100 is supported on a surface by a side of the container 104 (instead of by the bottom end 210 (see FIG. 2) of the container 104), during, for example, packing, shipping, transport, and/or storage, no portion of the trigger 108 contacts the surface, which reduces a likelihood of accidental actuation of the trigger 108. Further, such an arrangement also has the added benefit of providing for a more secure vertical orientation when the container 104 is provided adjacent other vertically oriented containers in a packing, shipping, transport, and/or storage situation where jostling of the containers may occur.

In some embodiments, the second outermost point 1006 of the trigger 108 is disposed on the lower end 438 of the grip portion 300 of the trigger 108. In other embodiments, the second outermost point 1006 is disposed on a different portion of the grip portion 300 and/or other component of the overcap 102. As used in this disclosure, an outermost point of a container is a point of the container that is disposed farthest away from a central, longitudinal axis of the container in a direction along a line or radius extending from and perpendicular to the longitudinal axis. As used in this disclosure, an outermost point of an overcap is a point of the overcap that is disposed farthest away from a central longitudinal axis of a container measured in a direction along a line or radius extending from and perpendicular to the longitudinal axis when the overcap is coupled to the container.

As may be seen in, for example, FIG. 18 of the present disclosure, the footprint of the dispensing system 100 provides for a container 104 with a larger diameter than portions of the overcap 102. Interestingly, this footprint was possible without a reduction in the volume of the container even though a larger trigger 108 is provided than conventionally found in similar sprayer systems. In fact, traditional containers utilize smaller triggers and, when a larger trigger is used, oftentimes the trigger extends out beyond the footprint of the container and/or the volume of the container must be reduced to accommodate an oversized overcap with a larger trigger. Neither of these drawbacks is present in the disclosed embodiments.

By way of a non-limiting example, standard containers include a height dimension between uppermost and lowermost ends of between about 245 to about 250 millimeters. Further, such containers preferably have a diameter of between about 52 to about 66 millimeters and, more preferably, between about 58 to about 59 millimeters. Still further, such containers typically have a volume of at least 8 ounces. Utilization of a longer trigger in traditional sprayers typically required such triggers to extend past a footprint or outermost diameter of the container to maintain the above-noted container dimensions. However, the present disclosure provides a unique solution to this problem by providing a trigger within the footprint of the container as disclosed herein. In one preferred embodiment, the lowermost end of the trigger (for example, lower end 438 of trigger 108) extends below an uppermost portion of the container (for example, the mounting cup 200 of the container 104).

Figure 19:
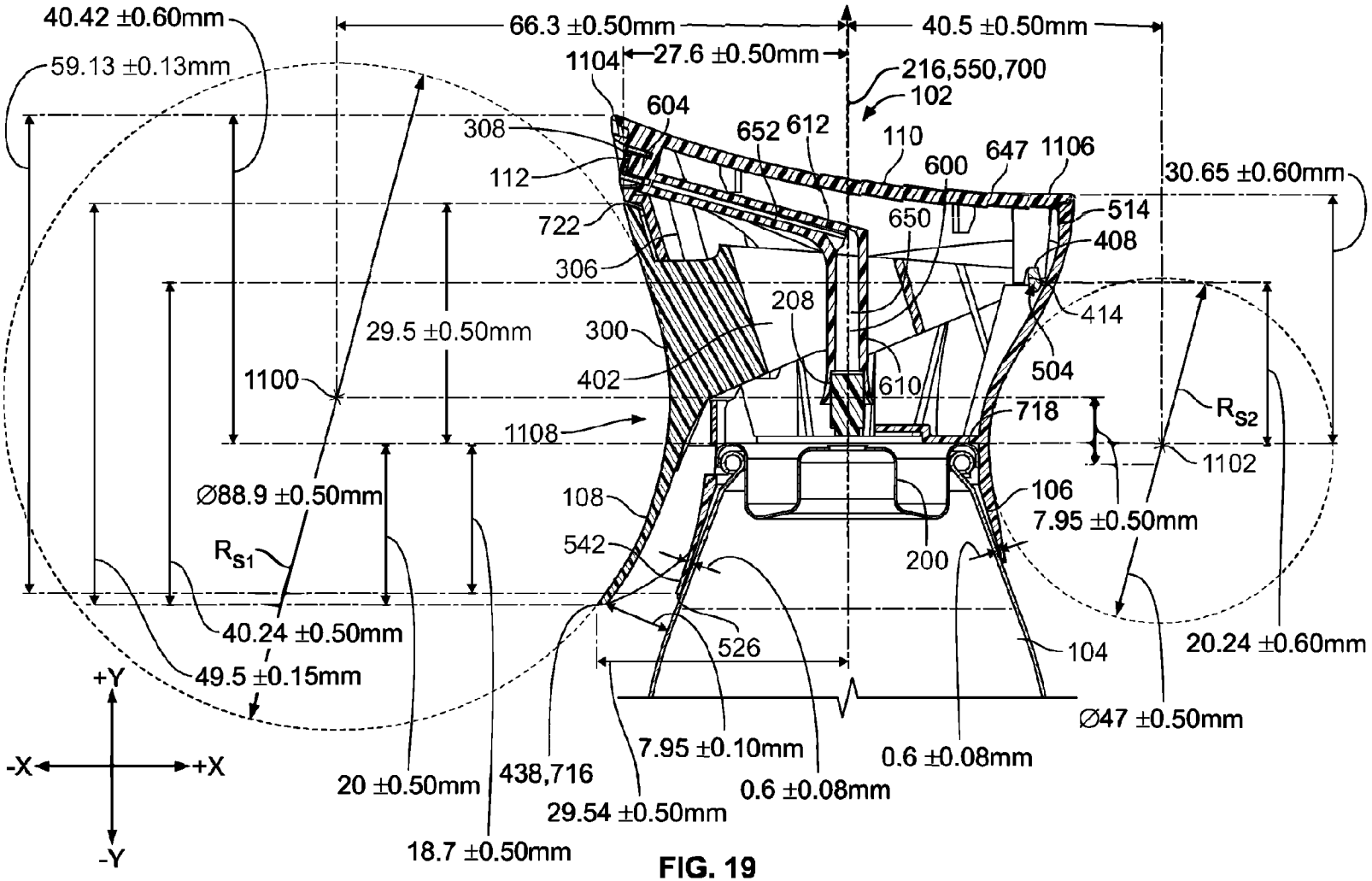
FIG. 19 is a cross-sectional view similar to the one shown in FIG. 12 further provided with representative dimensions that may be used to implement the dispensing system of FIGS. 1-18.

FIG. 19 is a cross-sectional view of the dispensing system 100 of FIGS. 1-18 showing dimensions that may be employed to implement the dispensing system 100. In the illustrated embodiment, the grip portion 300 of the trigger 108 is concave and has a smallest radius of curvature $R_{S1}$ of about 44.5 millimeters in a plane on which the longitudinal axis 550 lies and is perpendicular to the axis of rotation 414 of the trigger 108.

The second sidewall 514 of the housing 106, which is on an opposite side of the longitudinal axis 550 as the grip portion 300 of the trigger 108, is concave and has a smallest radius of curvature $R_{S2}$ of about 23.5 millimeters along the plane. Thus, the smallest radius of curvature $R_{S2}$ of the second sidewall 514 is about half of the smallest radius of curvature $R_{S1}$ of the grip portion 300 of the trigger 108. A center of curvature 1100 of the grip portion 300 is offset from a center of curvature 1102 of the second sidewall 514. For example, in the illustrated embodiment, the center of curvature 1100 of the grip portion 300 is offset by about 8 millimeters from the center of curvature 1102 of the second sidewall 514 in a direction along the longitudinal axis 550. The center of curvature 1100 of the grip portion 300 of FIG. 19 is farther from the uppermost point 718 of the container 104 than the center of curvature 1102 of the second sidewall 514 in the direction along the longitudinal axis 550.

In the illustrated embodiment, the center of curvature 1100 of the grip portion 300 is spaced apart from the center of curvature II 02 of the second sidewall 514 in a direction perpendicular to the longitudinal axis 550 by about 106.8 millimeters. For example, the center of curvature 1100 of the grip portion 300 is about 66.3 millimeters from the longitudinal axis 550 in the direction perpendicular to the longitudinal axis 550. Thus, the center of curvature 1102 of the second sidewall 514 is about 40.5 millimeters from the longitudinal axis 550 in the direction perpendicular to the longitudinal axis 550. In other embodiments, the center of curvature 1100 of the grip portion 300 is offset and/or spaced apart from the center of curvature 1102 of the second sidewall 514 by other distances and/or in other ways.

In the illustrated embodiment, the grip portion 300 of the trigger 108 has a length in a direction along the longitudinal axis 550 of about 48 millimeters to about 51 millimeters. In some embodiments, the grip portion 300 has a length in the direction along the longitudinal axis 550 of about 40 millimeters to about 60 millimeters. In the illustrated embodiment, the uppermost point 722 of the grip portion 300 of the trigger 108 is a distance of about 29.5 millimeters from the uppermost point 718 of the container 104 in the direction along the longitudinal axis 550. The lowermost point 716 of the grip portion 300 of the trigger 108 is disposed below the uppermost point 718 of the container 104 by a distance of about 20 millimeters in a direction along the longitudinal axis 550. Thus, about two fifths of the grip portion 300 of the trigger 108 is disposed below the uppermost point 718 of the container 104 in the direction along the longitudinal axis 550. The axis of rotation 414 of the trigger 108 is disposed above the uppermost point 718 of the container I 04 by a distance of about 20 millimeters in a direction along the longitudinal axis 550. Thus, the lowermost point 716 of the grip portion 300 of the trigger 108 is disposed below the axis of rotation 414 in the direction along the longitudinal axis 550 by a distance of about 40 millimeters.

Still referring to FIG. 19, a lowermost point on the second end 526 of the skirt 542 is a distance of about 18.5 millimeters below the uppermost point 718 of the container 104 in a direction along the longitudinal axis 550. The lowermost point on the second end 526 of the skirt 542 is a distance of about 59 millimeters from an uppermost point 1104 of the overcap 102 in the direction along the longitudinal axis 550. In the illustrated embodiment, the uppermost point 1004 of the overcap 102 is disposed on the upper surface 647 of the cap 110. A lowermost point 1106 of the upper surface 647 of the cap 110 is a distance of about 30.5 millimeters from the uppermost point 718 of the container 104 in a direction along the longitudinal axis 550. In the illustrated embodiment, the discharge outlet 308 is a distance of about 27.5 millimeters from the longitudinal axis 550 in a direction perpendicular to the longitudinal axis 550. The above-noted dimensions are merely examples and, thus, other dimensions may be employed without departing from the scope of this disclosure.

In the illustrated embodiment, when the trigger 108 is in the first or unactuated position, a waist 1108 of the overcap 102 is about 40 millimeters to about 42 millimeters. In some embodiments, the waist 1108 is about 30 millimeters to about 50 millimeters. As used in this disclosure, a waist of an overcap is a smallest distance from a point on an exterior surface of a grip portion (e.g., the grip portion 300) of a trigger having a smallest radius of curvature to a point on an exterior surface of a sidewall opposite the grip portion (e.g., the second sidewall 514) having a smallest radius of curvature. In the illustrated embodiment, the skirt 542 has a minimum thickness of about 0.6 millimeters. However, the above-noted dimensions are merely examples and, thus, other embodiments may employ other dimensions in accordance with the teachings of this disclosure. The above-noted shape, dimensions and/or proportions enable a user to easily grip the dispensing system 100 and actuate the trigger 108. Further, the curvatures of the grip portion 300 of the trigger 108 and the housing 106 direct a hand of the user to grip the dispensing system 100 at or near the waist 1108 of the overcap 102, which positions fingers of the user onto or near the lower end 438 of the grip portion 300 trigger 108. In some embodiments, the dispensing system 100 is sized such that users having average sized hands, below average sized hands, and above average sized hands can grip the dispensing system 100 with one hand at substantially the same position (i.e., at or near the waist 1108) and actuate the trigger 108.

Figure 20:
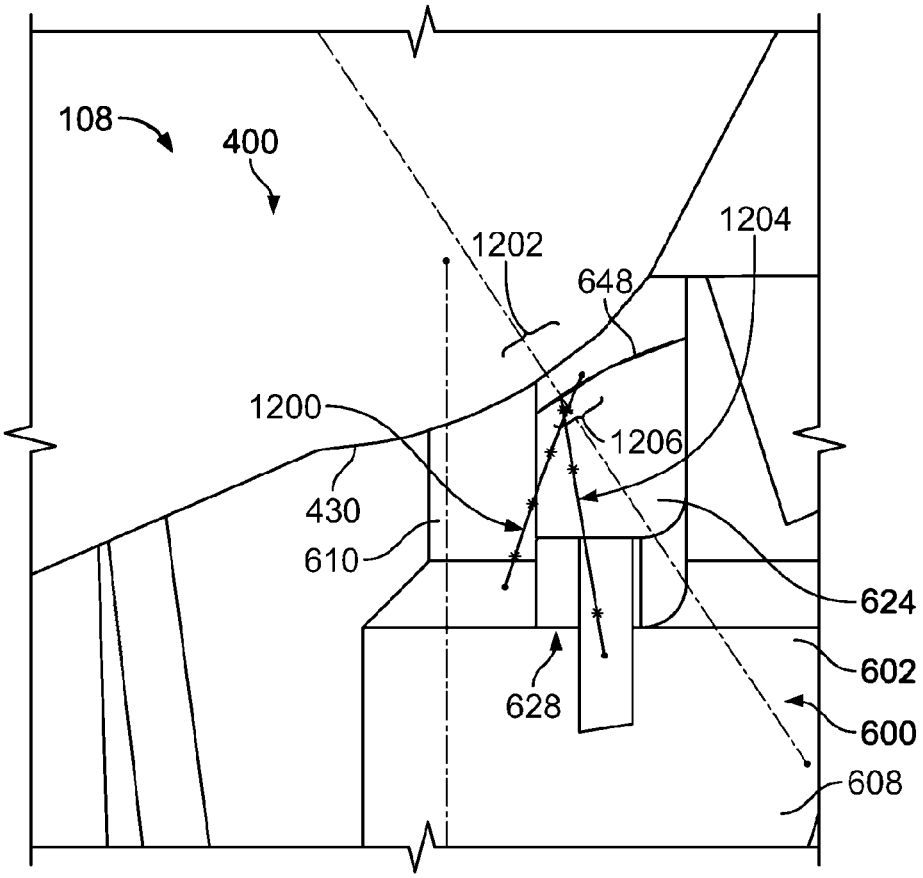
FIG. 20 is an enlarged, side view of the trigger of FIGS. 4 and 5 and the manifold of FIG. 10 illustrating a first path of trigger contact points and a second path of manifold contact points.

FIG. 20 is an enlarged, side view of the trigger 108 and the manifold 600 illustrating a first path 1200 of trigger contact points 1202 and a second path 1204 of manifold contact points 1206. As used in this disclosure, a trigger contact point is a point on a trigger that contacts a manifold during actuation of the trigger; a manifold contact point is a point on the manifold that is contacted by the trigger during actuation of the trigger. The trigger contact points 1202 are on the first contact surface 430 of the trigger 108. The manifold contact points 1206 are on the engaging surface 648 of the first protrusion 624. The second protrusion 626 of the manifold 600 is a mirror image of the first protrusion 624, and the second contact surface 432 is a mirror image of the first contact surface 430. Therefore, the foregoing and following description of the first protrusion 624 and the first contact surface 430 is applicable to the second protrusion 626 and the second contact surface 432. To avoid redundancy, the manifold contact points on the second protrusion 626 and the trigger contact points on the second contact surface 432 are not separately described.

When the trigger 108 moves from the first position to the second position, the first arm 400 rotates toward the container 104. As a result, the first contact surface 430 moves toward the container 104 and the second sidewall 514 (i.e., downward and rightward in the orientation of FIG. 17). When the first contact surface 430 contacts the engaging surface 648 of the first protrusion 624, the first end portion 602 of the manifold 600 moves toward the container 104 and toward the grip portion 300 of the trigger 108 (i.e., downward and leftward in the orientation of FIG. 17). As a result, the first contact surface 430 slides along the engaging surface 648 and, thus, the trigger contact points 1202 and the manifold contact points 1206 change during actuation of the trigger 108. The first path 1200 of the trigger contact points 1202 substantially corresponds to movement of the engaging surface 648 of the first protrusion 624 as the trigger 108 actuates from the first position to the second position. The second path 1204 of the manifold contact points 1206 substantially corresponds to movement of the first contact surface 430 as the trigger 108 moves from the first position to the second position. Table 1 below illustrates example vector components of the trigger contact points 1202 and the manifold contact points 1206 as the trigger 108 moves from the first position to the second position.

TABLE 1

| Force | Trigger Displacement | Trigger Contact Points | | | | Manifold Contact Points | | | |
|---|---|---|---|---|---|---|---|---|---|
| (N) | Magnitude | Magnitude | Z | Y | X | Magnitude | Z | Y | X |
| 1 | 1.21 | 0.438 | −0.001 | −0.399 | −0.179 | 0.159 | 0.002 | −0.157 | 0.026 |
| 5 | 2.78 | 0.934 | −0.006 | −0.862 | −0.360 | 0.822 | 0.009 | −0.811 | 0.136 |
| 10 | 4.75 | 1.549 | −0.012 | −1.442 | −0.565 | 1.647 | 0.019 | −1.624 | 0.273 |
| 15 | 6.74 | 2.167 | −0.018 | −2.030 | −0.757 | 2.474 | 0.029 | −2.440 | 0.410 |
| 18 | 7.93 | 2.538 | −0.022 | −2.383 | −0.872 | 2.970 | 0.035 | −2.929 | 0.493 |

Figure 21:
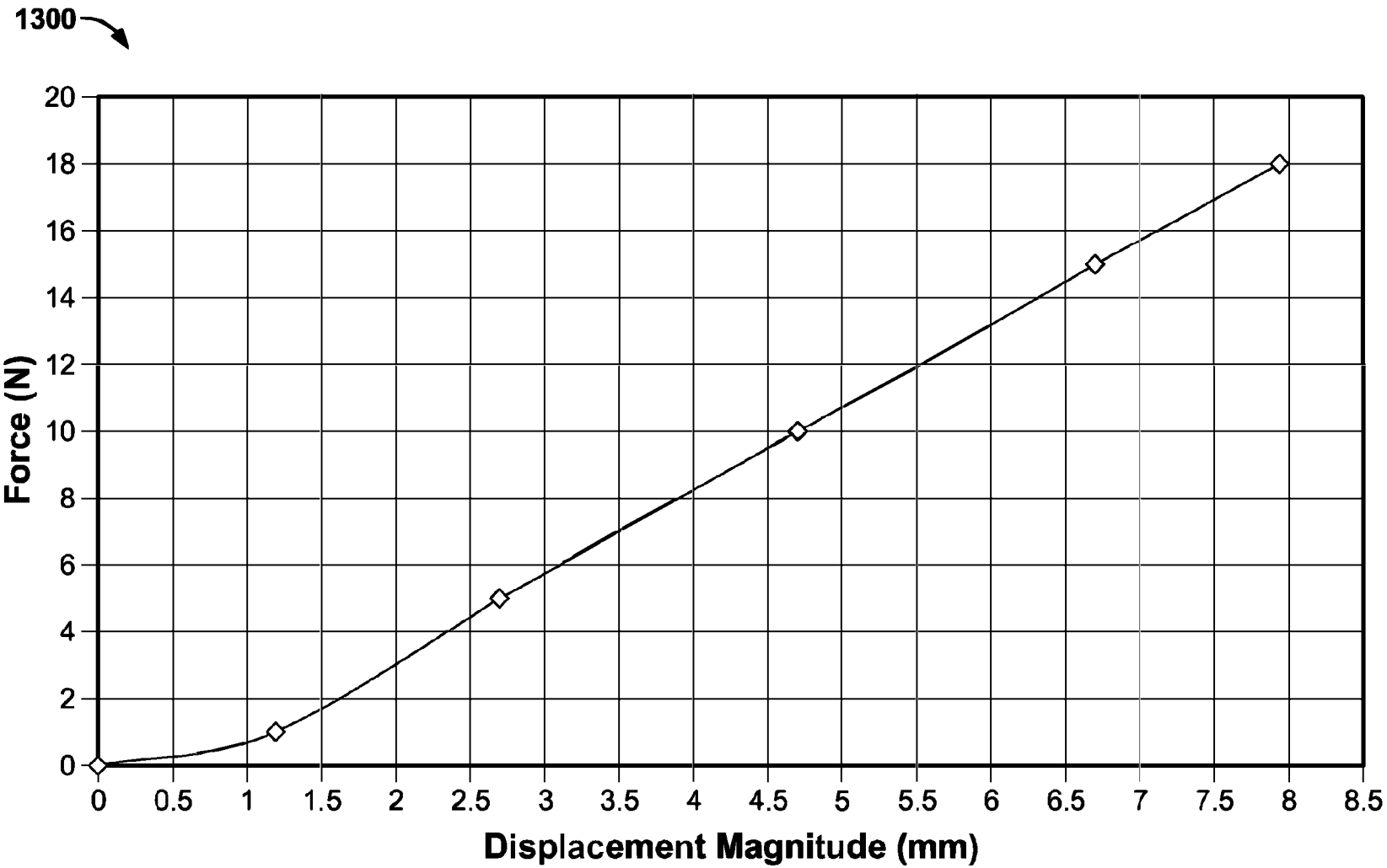
FIG. 21 is a graph of example forces applied to the trigger of FIGS. 4 and 5 relative to example magnitudes of displacement of the trigger.

FIG. 21 is a graph 1300 of example forces applied to the trigger 108 relative to example magnitudes of displacement of the trigger I 08 during actuation of the trigger 108. In the illustrated embodiment, the forces are determined when the overcap 102 is not coupled to the container 104 and, thus, the forces do not include forces to depress the valve stem 208. In the illustrated embodiment, the force to move the trigger 108 from the first position to the second position increases to a maximum force of about 18 Newton. A maximum magnitude of displacement of the trigger 108 is about 7.93 millimeters. In the illustrated embodiment, a relationship between the forces applied to the trigger 108 and the magnitudes of displacement of the trigger 108 is substantially linear when the trigger 108 is displaced from magnitudes of about 1.21 millimeters to about 7.93 millimeters. In other embodiments, the forces, the magnitudes of displacement, and/or the relationship between the forces and the magnitudes of displacement are different than illustrated in FIG. 21.

Figure 22:
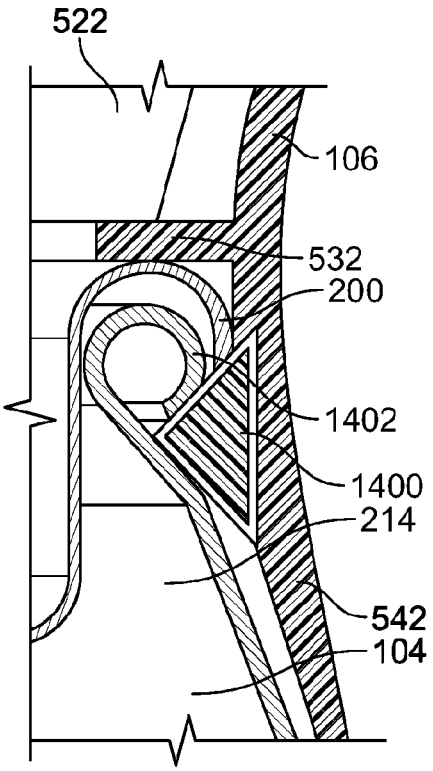
FIG. 22 is an enlarged, cross-sectional view along line 22-22 of FIG. 1 depicting an alternative coupling between the overcap and the container.

FIG. 22 is an enlarged cross-sectional, side view of the container 104 and the housing 106 of the overcap 102 along line 22-22 of FIG. 1, illustrating an alternative protrusion 1400 securing the overcap 102 to the container 104. For example, the protrusion 1400 of FIG. 22 may cooperate with the second flange 532 to snap-fit the housing 106 onto the container 104. In the illustrated embodiment, the protrusion 1400 has a triangular-shaped cross-sectional shape. In other embodiments, the protrusion 1400 has other cross-sectional shapes. The protrusion 1400 extends from the housing 106 and is spaced apart from the second flange 532. In the illustrated embodiment, the protrusion 1400 contacts a curled portion 1402 of the container 104 on which the mounting cup 200 is disposed to secure the overcap 102 to the container 104. In some embodiments, the protrusion 1400 does not contact the mounting cup 200. In other embodiments, the protrusion 1400 contacts the curled portion 1402 and the mounting cup 200.

Figure 23:
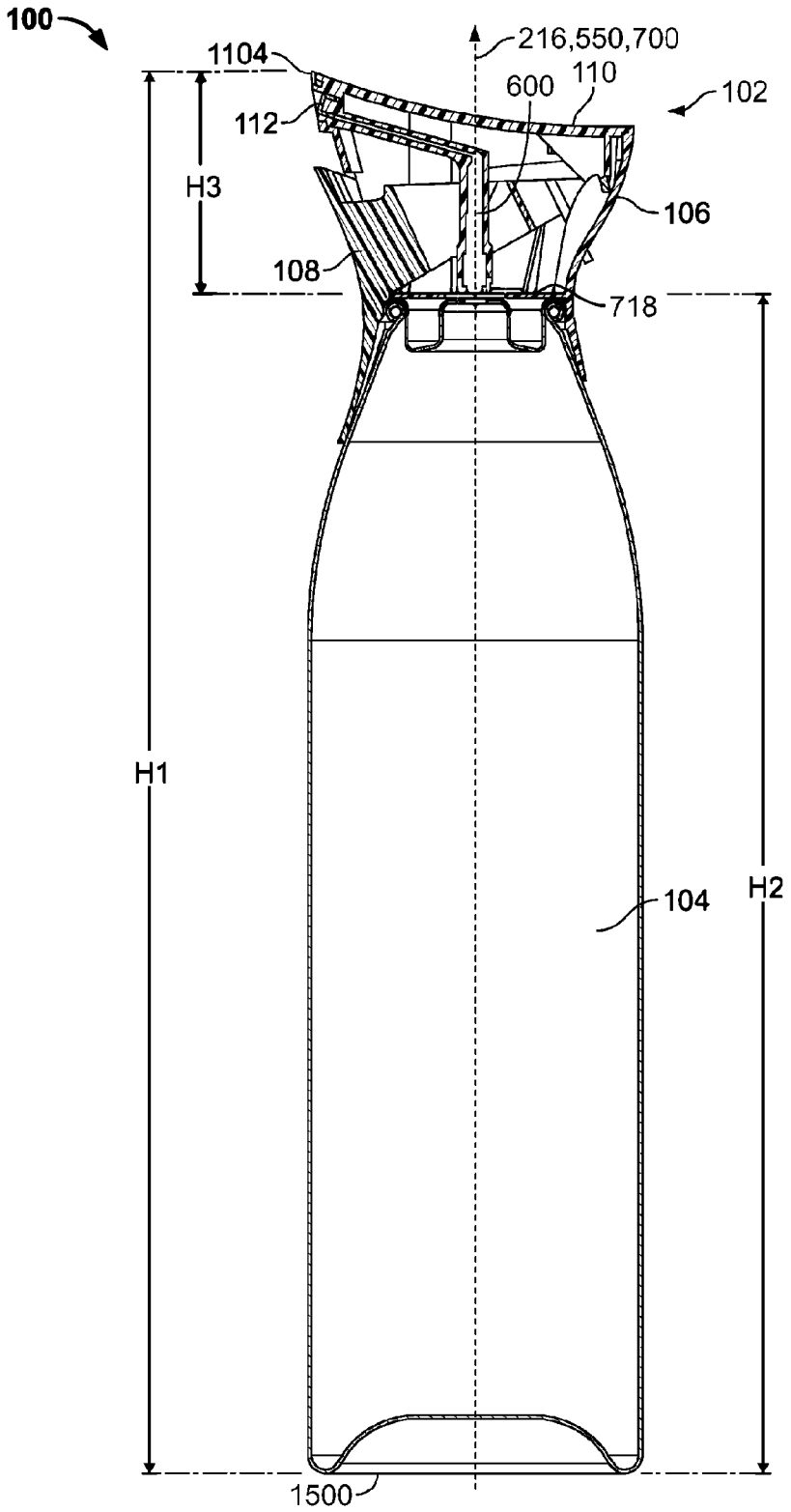
FIG. 23 is a cross-sectional view along line-23-23 of FIG. 1 depicting the dispensing system of FIGS. 1-20.

FIG. 23 is a cross-sectional view of the dispensing system 100 of FIGS. 1-21 showing dimensions that may be employed to implement the dispensing system 100. In the illustrated embodiment, the dispensing system 100 has a height H1 of about 244.5 millimeters to about 248.5 millimeters. The height H1 of the dispensing system 100 is measured from the uppermost point 1104 of the overcap 102 to a lowermost point 1500 of the container 104 in a direction along the longitudinal axis 550 of the dispensing system 100. The container 104 has a height H2 of about 205 millimeters to about 208 millimeters. The height H2 of the container 104 is measured from the uppermost point 718 of the container 104 to the lowermost point 1500 of the container 104 along the longitudinal axis 550 of the dispensing system 100. Thus, the overcap 102 extends above the uppermost point 718 of the Container 104 by a height H3 of about 40 millimeters in a direction along the longitudinal axis 550. As a result, the overcap 102 accounts for about one sixth to about one seventh of the height H1 of the dispensing system 100. Thus, the overcap 102 of the dispensing system 100 disclosed herein is smaller and/or more compact than overcaps of traditional dispensing systems. As a result, a container (e.g., the container 104) having a greater height and, thus, a larger volume may be employed by the dispensing system 100 relative to traditional dispensing systems with the same height H1 and the same footprint (e.g., the footprint 1000 of FIG. 18) as the dispensing system 100.

Figure 24:
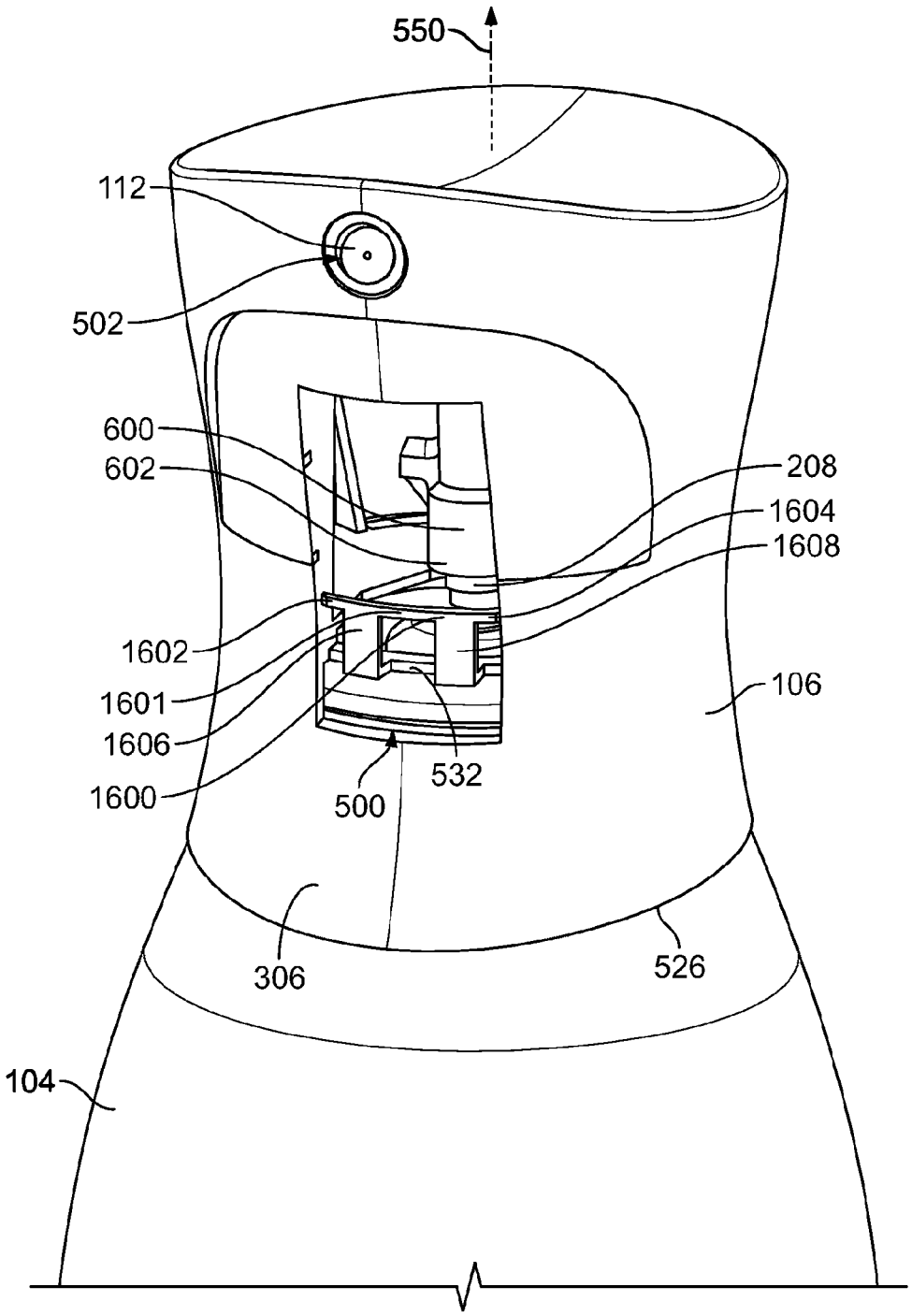
FIG. 24 is a perspective view of a tamper resistant device which may be employed to implement the dispensing system of FIGS. 1-23.

FIG. 24 is a perspective view of the dispensing system 100 including a tamper resistant device 1600 having frangible or breakable beam 1601 spanning the first aperture 500 of the housing 106 of the overcap 102. In the illustrated embodiment, the trigger 108 is not shown. The beam 1601 of FIG. 24 is shown in a first or unbroken state. The beam 1601 is in the first state when the trigger 108 has not been actuated for a first time. When the beam 1601 is in the first state, a first end 1602 and a second end 1604 of the beam are coupled to (e.g., integrally formed with) the housing 106.

The beam 1601 of FIG. 24 is substantially horizontal or perpendicular to the longitudinal axis 550 of the dispensing system 100. In other embodiments, the beam 1601 is oriented in other ways. A first leg 1606 and a second leg 1608 support the beam 1601. In the illustrated embodiment, the first leg 1606 and the second leg 1608 extend from the second flange 532. In some embodiments, the beam 1601, the first leg, 1606, the second leg 1608, and the housing 106 are integrally formed. In other embodiments, the beam 1601 is coupled to the housing 106 in other ways.

When the trigger 108 is in the unactuated state, the beam 1601 is disposed below the first arm 400, the second arm 402, and the third brace 420 (FIGS. 4 and 5) of the trigger 108. When the trigger 108 is actuated for the first time, the trigger 108 rotates toward the container 104, and the first arm 400, the second arm 402, and/or the third brace 420 contact the beam 1601. As a result, the trigger 108 applies force to the beam 1601 sufficient to sever or separate the first end 1602 and the second end 1604 of the beam 1601 from the housing 106. When the beam 1601 severs or separates from the housing 106, the beam 1601 is in a second or broken state. As a user further squeezes the trigger 108, the tamper resistant device 1600 bends or sways toward the longitudinal axis 550 to enable the trigger 108 to move to the actuated position. For example, the force applied to the beam 1600 may bend the legs 1606, 1608 toward the longitudinal axis 550. In some embodiments, substantially no portions of the beam 1601 separate or break off from the beam 1601 and/or the legs 1606, 1608. When the trigger 108 is actuated for a second time, the trigger 108 contacts the beam 1601 and applies force to the beam 1601. As a result, the tamper resistant device 1600 bends or sways toward the longitudinal axis 550 to enable the trigger 108 to move to the actuated position. In some embodiments, when the tamper resistant device 1600 bends or sways, the beam 1601 and/or the legs 1606, 1608 apply a spring force to the trigger 108, which biases or urges the trigger 108 toward the unactuated position.

INDUSTRIAL APPLICABILITY

The examples disclosed herein can be used to dispense or discharge fluid products from a container.

Numerous modifications to the examples disclosed herein will be apparent to those skilled in the art in view of the foregoing description. Accordingly, this disclosure is to be construed as illustrative only and is presented for the purpose of enabling those skilled in the art to make and use the claimed invention and to teach the best mode of carrying out same. The exclusive rights to all modifications which come within the scope of the claims are reserved. All patents and publications are incorporated by reference.

What is claimed is:

1. A dispensing system, comprising:

a container having a central, longitudinal axis, a first outermost point of the container being a first distance from the central, longitudinal axis along a first line perpendicular to the central, longitudinal axis; and an overcap coupled to the container, the overcap including a pivotable trigger that is configured to pivot between an unactuated position and an actuated position, wherein a first outermost point of the trigger is a second distance from the central, longitudinal axis along a second line perpendicular to the central, longitudinal axis when the trigger is in the unactuated position, the second distance is less than the first distance, and wherein the first outermost point of the trigger moves toward the central, longitudinal axis when the trigger moves toward the actuated position; and wherein a portion of the trigger extends below an uppermost point of the container in a direction along the central, longitudinal axis.

2. The dispensing system of claim 1, wherein the container further includes a mounting cup, and wherein a grip portion of the trigger extends below the mounting cup of the container in a direction along the central, longitudinal axis.

3. The dispensing system according to claim 1, wherein the trigger has a length in a direction along the central, longitudinal axis between 40 millimeters and 60 millimeters.

4. The dispensing system according to claim 1, wherein the trigger has a grip portion that includes a lowermost point that moves along an arcuate path having an arc length of between 4 millimeters and less than 14 millimeters.

5. The dispensing system according to claim 1, wherein the container has a first footprint and the overcap has a second footprint, and wherein the second footprint of the overcap is disposed entirely within the first footprint.

6. The dispensing system according to claim 1, wherein a total range of movement of the trigger is between 2 degrees and less than 10 degrees of rotation of the trigger.

7. The dispensing system according to claim 1, wherein the trigger has a first portion adjacent a discharge outlet and a second portion adjacent the container, the first portion having a first thickness and the second portion having a second thickness less than the first thickness.

8. The dispensing system according to claim 1, wherein the trigger has a grip portion that includes an upper end that moves away from the central, longitudinal axis when the trigger moves toward the actuated position.

9. The dispensing system according to claim 1, wherein the trigger has an uppermost point adjacent a discharge outlet and a lowermost point adjacent the container, and wherein the trigger is dimensioned such that the uppermost point and the lowermost point follow the same trajectory when the trigger pivots about an axis of rotation.

10. The dispensing system according to claim 1, wherein the overcap includes an elastically deformed skirt conforming to a shape of the container.

11. The dispensing system of claim 1, wherein the portion of the trigger is curved about a first axis of curvature.

12. The dispensing system of claim 11, wherein the portion of the trigger is curved about a second axis of curvature perpendicular to the first axis of curvature.

13. The dispensing system according to claim 1, wherein the overcap includes a housing, a cap coupled to the housing, and a manifold integrally formed with the cap.

14. The dispensing system of claim 13, wherein the trigger has a grip portion that includes a lowermost point that moves along a first arcuate path, and an end portion of the manifold moves along a second arcuate path opposing the first arcuate path when the trigger moves from the unactuated position to the actuated position.

15. The dispensing system according to claim 1, wherein the overcap includes a first sidewall and a second sidewall opposite the first sidewall, and wherein the trigger includes an arm extending through an aperture of the first sidewall and pivotably coupled to the second sidewall.

16. The dispensing system according to claim 15, wherein the trigger has a grip portion that is concave-shaped and the second sidewall is concave-shaped.

17. A dispensing system, comprising:

a container having a central, longitudinal axis, a first outermost point of the container being a first distance from the central, longitudinal axis along a first line perpendicular to the central, longitudinal axis; and an overcap coupled to the container, the overcap including a trigger configured to angularly move between an unactuated position and an actuated position, wherein a first outermost point of the trigger is a second distance from the central, longitudinal axis along a second line perpendicular to the central, longitudinal axis when the trigger is in the unactuated position, the second distance is less than the first distance, and wherein the first outermost point of the trigger moves toward the central, longitudinal axis when the trigger moves toward the actuated position, and wherein an upper end of the trigger moves away from the central, longitudinal axis when the trigger moves toward the actuated position.

18. The dispensing system of claim 17, wherein an upper end of a grip portion of the trigger moves away from the central, longitudinal axis when the trigger moves toward the actuated position.

19. A dispensing system, comprising:

a container having a central, longitudinal axis, a first outermost point of the container being a first distance from the central, longitudinal axis along a first line perpendicular to the central, longitudinal axis; and an overcap coupled to the container, the overcap having a first outermost point, and including a trigger having a grip portion, configured to move between an unactuated position and an actuated position, wherein the first outermost point of the overcap is a second distance from the central, longitudinal axis along a second line perpendicular to the central, longitudinal axis, the second distance is less than the first distance, wherein the overcap further includes a manifold, and wherein a lowermost point of the grip portion moves along a first arcuate path, and an end portion of the manifold moves along a second arcuate path opposing the first arcuate path when the trigger moves from the unactuated position to the actuated position.

* * * * *